US010035062B2

(12) United States Patent
Kawabata et al.

(10) Patent No.: US 10,035,062 B2
(45) Date of Patent: Jul. 31, 2018

(54) ROULETTE LOTTERY APPARATUS

(71) Applicant: SEGA SAMMY CREATION INC., Tokyo (JP)

(72) Inventors: Masaki Kawabata, Tokyo (JP); Naoya Yamaguchi, Tokyo (JP)

(73) Assignee: SEGA SAMMY CREATION INC., Tokyo (JP)

( * ) Notice: Subject to any disclaimer, the term of this patent is extended or adjusted under 35 U.S.C. 154(b) by 0 days.

(21) Appl. No.: 14/655,137

(22) PCT Filed: Sep. 11, 2013

(86) PCT No.: PCT/JP2013/074589
§ 371 (c)(1),
(2) Date: Jun. 24, 2015

(87) PCT Pub. No.: WO2015/037091
PCT Pub. Date: Mar. 19, 2015

(65) Prior Publication Data
US 2015/0321082 A1 Nov. 12, 2015

(51) Int. Cl.
*A63F 1/18* (2006.01)
*A63F 5/00* (2006.01)
(Continued)

(52) U.S. Cl.
CPC ..... *A63F 5/0076* (2013.01); *A63F 5/0088* (2013.01); *A63F 5/02* (2013.01);
(Continued)

(58) Field of Classification Search
CPC ..... A63F 1/18; A63B 71/00
(Continued)

(56) References Cited

U.S. PATENT DOCUMENTS 3,090,623 A * 5/1963 Dugan ..... A63F 5/00 273/121 R
3,997,045 A * 12/1976 Yeung ..... A45C 1/12 194/339
(Continued)

FOREIGN PATENT DOCUMENTS

JP S49-082889 U 7/1974
JP 9-234269 A 9/1997
(Continued)

OTHER PUBLICATIONS

Office Action issued in related application JP 2014-512198, dated Apr. 18, 2017, with partial English language translation, 5 pages.

*Primary Examiner* — John E Simms, Jr.
*Assistant Examiner* — Dolores Collins
(74) *Attorney, Agent, or Firm* — Drinker Biddle & Reath LLP

(57) ABSTRACT

A roulette lottery apparatus with a novel configuration causes a player not to lose interest. The roulette lottery apparatus 1 for a roulette game comprises: plural roulette bodies that have plural ball pockets into which lottery balls enter, the plurality of roulette bodies being held so as to be rotatable about a horizontal or tilted rotation axis in a state where a rotation plane of the ball pockets is raisable, each of the plurality of the roulette bodies having different diameters; a drive source that rotationally drives the roulette bodies; and ball guide members that guide the balls to enter into any ball pocket among the ball pockets while causing the balls to be in pendular movement. The plural roulette bodies are arranged in a stepped state in which the roulette bodies are displaced in an axis direction on the rotation center line.

10 Claims, 25 Drawing Sheets

(51) Int. Cl.
*A63F 5/02* (2006.01)
*A63F 5/04* (2006.01)
*G07F 17/32* (2006.01)

(52) U.S. Cl.
CPC ..... *A63F 5/043* (2013.01); *G07F 17/3202* (2013.01); *G07F 17/3213* (2013.01); *A63F 5/045* (2013.01)

(58) Field of Classification Search
USPC ..... 273/142 E
See application file for complete search history.

(56) References Cited

U.S. PATENT DOCUMENTS 5,102,135 A * 4/1992 Addiechi ..... A63F 5/0088 273/142 E
5,222,736 A * 6/1993 Workman ..... A63F 5/02 273/118 R
5,755,440 A * 5/1998 Sher ..... A63F 5/00 273/142 E
6,083,105 A * 7/2000 Ronin ..... A63F 5/0005 273/142 E
6,209,869 B1 * 4/2001 Mathews ..... A63F 5/00 273/138.1
6,497,409 B2 * 12/2002 Mathews ..... A63F 5/00 273/138.1
6,855,052 B2 * 2/2005 Weiss ..... G07F 17/32 273/143 R
7,571,910 B1 8/2009 Launzel
7,674,172 B2 * 3/2010 Miltenberger ..... A63F 5/00 273/142 E
7,946,914 B2 * 5/2011 Vancura ..... G07F 17/3267 273/142 B
8,029,351 B2 * 10/2011 Kosaka ..... A63F 5/00 273/274
8,142,273 B2 * 3/2012 Williams ..... G07F 17/3202 463/20
8,348,277 B2 * 1/2013 Fitoussi ..... A63F 5/00 273/142 E
8,444,470 B2 * 5/2013 Gurule ..... G07F 17/3258 463/17
2002/0163124 A1 * 11/2002 Weigl ..... G06Q 30/02 273/142 R
2003/0094752 A1 * 5/2003 Mathews ..... A63F 5/00 273/138.1
2008/0139280 A1 6/2008 Inamura
2008/0214264 A1 * 9/2008 Griswold ..... A63F 5/00 463/17
2010/0102507 A1 * 4/2010 Bontempo ..... A63F 5/00 273/142 R
2010/0120488 A1 * 5/2010 Savytskyy ..... G07F 17/32 463/17
2011/0210510 A1 9/2011 Matsuki et al.
2012/0112408 A1 * 5/2012 Poon ..... A63F 5/045 273/142 R
2012/0175840 A1 * 7/2012 Zerga ..... A63F 5/00 273/142 E
2012/0238343 A1 * 9/2012 Perrone ..... G07F 17/3262 463/17

FOREIGN PATENT DOCUMENTS

JP 2007-75593 A 3/2007
JP 2008-119296 A 5/2008
JP 4302699 B2 7/2009
JP 2009-189546 A 8/2009
WO 2010/058712 A1 5/2010
WO 2011/145376 A1 11/2011

* cited by examiner 50
52
52a
55A
59A
52
52a
52
52a
52
52a

ROULETTE LOTTERY APPARATUS

CROSS-REFERENCE TO RELATED APPLICATION

This application is the U.S. national phase of the International Patent Application No. PCT/JP2013/074589 filed Sep. 11, 2013, the entire content of which is incorporated herein by reference.

FIELD

The present disclosure relates to a roulette lottery apparatus.

BACKGROUND

A roulette game in which a betting target is one of plural pockets formed in a roulette board (also referred to as a will, a wheel, or the like) into which a ball will enter has been enjoyed in a game hall or the like. The roulette body is provided with pockets having numerals of "0" and "1" to "36" attached thereto and an additional pocket of "00" in some cases, and the number of the pocket into which the ball enters is determined as a winning number.

As a system causing a player not to gradually lose interest even when a game is repeatedly played, a roulette game system is proposed which has two roulette boards arranged and gives a prize in complex consideration of the results of two games (for example, see JP2008-119296A).

However, when a player plays repeatedly a game using such a roulette game system, it cannot be said that the player does not lose interest in the game.

Therefore, an object of the present disclosure is to provide a roulette lottery apparatus with a novel configuration which causes a player not to lose interest.

SUMMARY

In order to achieve the above-mentioned object, there is provided a roulette lottery apparatus for a roulette game comprising:

plural roulette bodies in which plural ball pockets into which lottery balls enter is arranged in an annular shape, the plural roulette bodies being held so as to be rotatable about a common rotation center line in a state where a rotation plane of the ball pockets is raisable, each of the plural roulette bodies having different diameters;

a drive source that rotationally drives the roulette bodies; and ball guide members that guide the balls to enter into any ball pocket among the plural ball pockets while causing the balls to be in pendular movement, wherein the plural roulette bodies are arranged in a stepped state in which the roulette bodies are displaced in a direction of the rotation center line.

Since the roulette lottery apparatus has plural roulette bodies having different diameters and holds the roulette bodies in a state where the rotation plane is propped to be raisable, it is possible to give a player a novel impression different greatly from the general concept of a roulette apparatus which is considered to be understood by players or the like. The roulette lottery apparatus can easily provide visual impact and is unique enough to be conspicuous, for example, even in a spectacular game hall such as a casino, and can provide overwhelming presence capable of catching eyes of viewers (spectators) such as players.

In the roulette lottery apparatus, since plural roulette bodies are displaced in the front-and-rear direction along the rotation center line, viewers (spectators) can easily feel a sense of depth and can easily visually recognize movements of the balls or the like in the roulette bodies from any position other than the front side, such as a diagonal front position. The roulette lottery apparatus can be particularly suitable as a lottery apparatus in a multiplayer game system causing multiple players to simultaneously enjoy the game using one roulette lottery apparatus. The sense of depth can provide a feeling of largeness and thus may provide a powerful feeling.

Unlike a conventional roulette board rotating horizontally about a vertical axis, in the present disclosure, since the rotation plane of the roulette bodies is raisable, the ball does not exhibit conventional movement of monotonous revolution in the horizontal plane, but exhibits novel and interesting movement in which the ball swings to the right and left sides (pendular movement) along the ball guide member and enters into a pocket when the amplitude decreases. Depending on various factors such as the size of the ball, the ball in pendular movement may smoothly enter into any pocket or may also bound from the roulette bodies and swing for a long time. The ball exhibits behavior differing greatly from that in the conventional roulette lottery apparatus, which gives a fresh or interesting impression to the spectators. The players hardly lose interest.

Since the plural roulette bodies are arranged in a stepped state where they are displaced along the rotation center line, it is easy to mechanically superimpose the roulette bodies. In other words, by displacing mechanisms for rotatably supporting or rotationally driving the roulette bodies in the direction parallel to the rotation center line and in the radial direction, the roulette bodies can be arranged without interfering with each other.

Since the plural roulette bodies are arranged in a stepped state where they are displaced along the rotation center line, the ball guide members receiving swinging movement of the balls can be formed using the stepped portions.

It is preferable for the roulette lottery apparatus to further comprise plural annular rails and for the plural roulette bodies to rotate along any one of the plural annular rails. When the plural roulette bodies are rotatably supported by only a central shaft, there may be constraints in strength and design. However, when the annular rails are used as in the present disclosure, the central shaft becomes unnecessary and is advantageous for an increase in size. When the central shaft is unnecessary, a further novel configuration can be provided and, for example, a monitor is arranged in the center of the roulette bodies.

It is preferable for the roulette bodies located on an inner side among the plural roulette bodies to be arranged so as to be closer to a rear surface of the roulette lottery apparatus than roulette bodies located on an outer side. In this way, when the plural roulette bodies are arranged in a mortar shape, a stereoscopic effect is generated, a sense of depth can be easily achieved, and movement of the roulette bodies or the balls can be easily visually recognized from any position (a diagonal front position or the like) other than the front side.

In the roulette lottery apparatus, the balls and the ball pockets of the roulette body located on the inner side among the plural roulette bodies may be smaller than the balls and the balls pockets located on the outer side. When the sizes of the balls and the ball pockets are different, the movement at the time of lotteries is different from that in conventional roulettes and it is thus possible to give a different impression and to change an atmosphere of a lottery.

In the roulette lottery apparatus, angular speeds of each of the plural roulette bodies may be different from each other. In this case, spectators can obtain a feeling of novelty at the time of a lottery.

Circumferential speeds of each of the plural roulette bodies may be equal to each other. For example, when mechanisms for transmitting a drive force to the outer circumference of the roulette bodies to rotate are employed, the same drive mechanism (for example, a drive system including a motor or the same type of pin gear wheel) can be used for all the roulette bodies and the drive force transmission speeds for all the roulette bodies may be made to be equal to each other.

In the roulette lottery apparatus, it is preferable for lotteries using the plural roulette bodies to be sequentially carried out. In this way, when the lotteries are carried out with a time difference between the roulette bodies, it is easy to confirm the lottery in each roulette body.

In this case, it is preferable for the lotteries using the plural roulette bodies to be carried out from the inner side to the outer side. In this case, directing can be performed so as to first carry out the lottery using the small roulette body on the inner side and to finally carry out the lottery using the largest and powerful roulette body on the outer side. By this directing, it is possible to give an impression as if the roulette bodies sequentially get closer in the lotteries.

One roulette body may be stopped and then a next roulette body may be rotated at a time of carrying out the lotteries using the plural roulette bodies. In this case, it is easy to visually recognize the lotteries using the roulette bodies and it is unlikely that spectators become dizzy.

In the roulette lottery apparatus, at least a part of a number display section of the roulette bodies may be formed of a light-transmitting material and a light source that emits light from a rear surface of the number display section may be further installed. In this case, the number display sections of the roulette bodies look like shining.

In this case, it is preferable for the light source to be fixed so as not to rotate. When a structure in which a light source rotates is employed, conduction members such as a rotor or a brush are necessary. However, according to the present disclosure, the wiring or the configuration is simplified.

According to the present disclosure, it is possible to provide a novel configuration which causes a player not to lose interest.

DETAILED DESCRIPTION

Hereinafter, the configuration of the present disclosure will be described in detail in conjunction with embodiments illustrated in the accompanying drawings.

Figure 1:
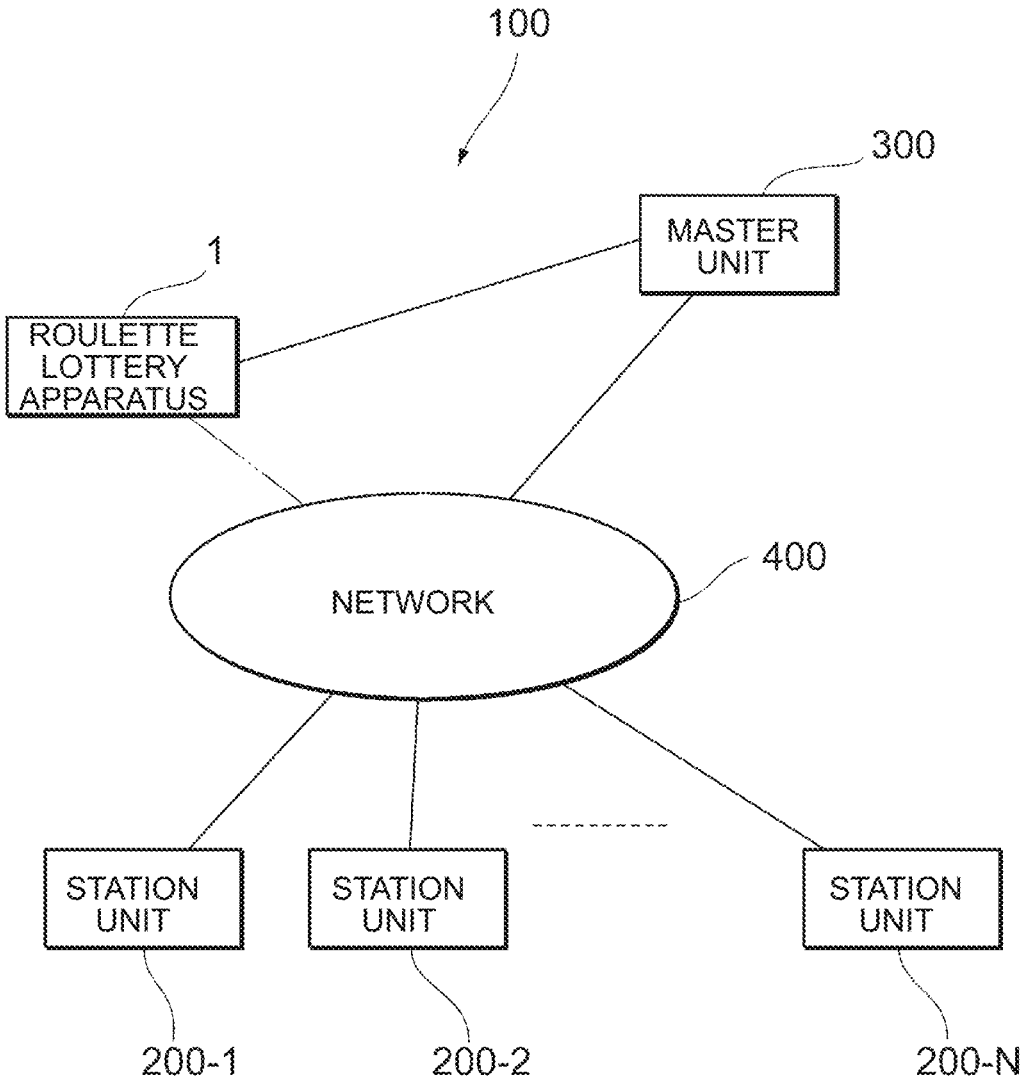
FIG. 1 is a diagram schematically illustrating a configuration of a roulette game system according to an embodiment of the present disclosure.

A game system 100 according to an embodiment comprises a roulette lottery apparatus 1 which is a main lottery machine (a main apparatus), plural station units 200-N (where N is a natural number of 2 or greater) for causing a player to perform a betting operation in a roulette game, and a master unit 300 for controlling the roulette lottery apparatus 1 and the station units 200-N (see FIG. 1). The game system 100 according to this embodiment further comprises a side monitor 500 (see FIG. 4 and the like).

In the game system 100, a large-size roulette lottery apparatus 1 is employed, and plural station units 200-N are arranged in front of the roulette lottery apparatus 1, and a novel and interesting game in which multiple players simultaneously enjoy the same roulette game (a game based on a lottery result using a single roulette lottery apparatus 1) is provided. In the below description, a side (side on which the station units 200-N are arranged) on which players are located when viewed from the roulette lottery apparatus 1 is defined as a front side and the opposite side thereof is defined as a rear side, whereby the front-and-rear direction is defined (see FIG. 8). A direction perpendicular to the front-and-rear direction (direction connecting the front surface and the rear surface) in the horizontal plane is a right-and-left direction.

The roulette lottery apparatus 1 and the master unit 300 are connected to each other and the master unit 300 and the station units 200-N (hereinafter, simply referred to as "station unit 200" when the station units do not need to be identified) are connected to each other via a network 400 such as a local area network (LAN), a wide area network (WAN), or the Internet in a wired and/or wireless communication manner. Players participating in a roulette game can perform a betting operation at the station units 200 to enjoy the game (see FIG. 3 or the like).

Figure 3:
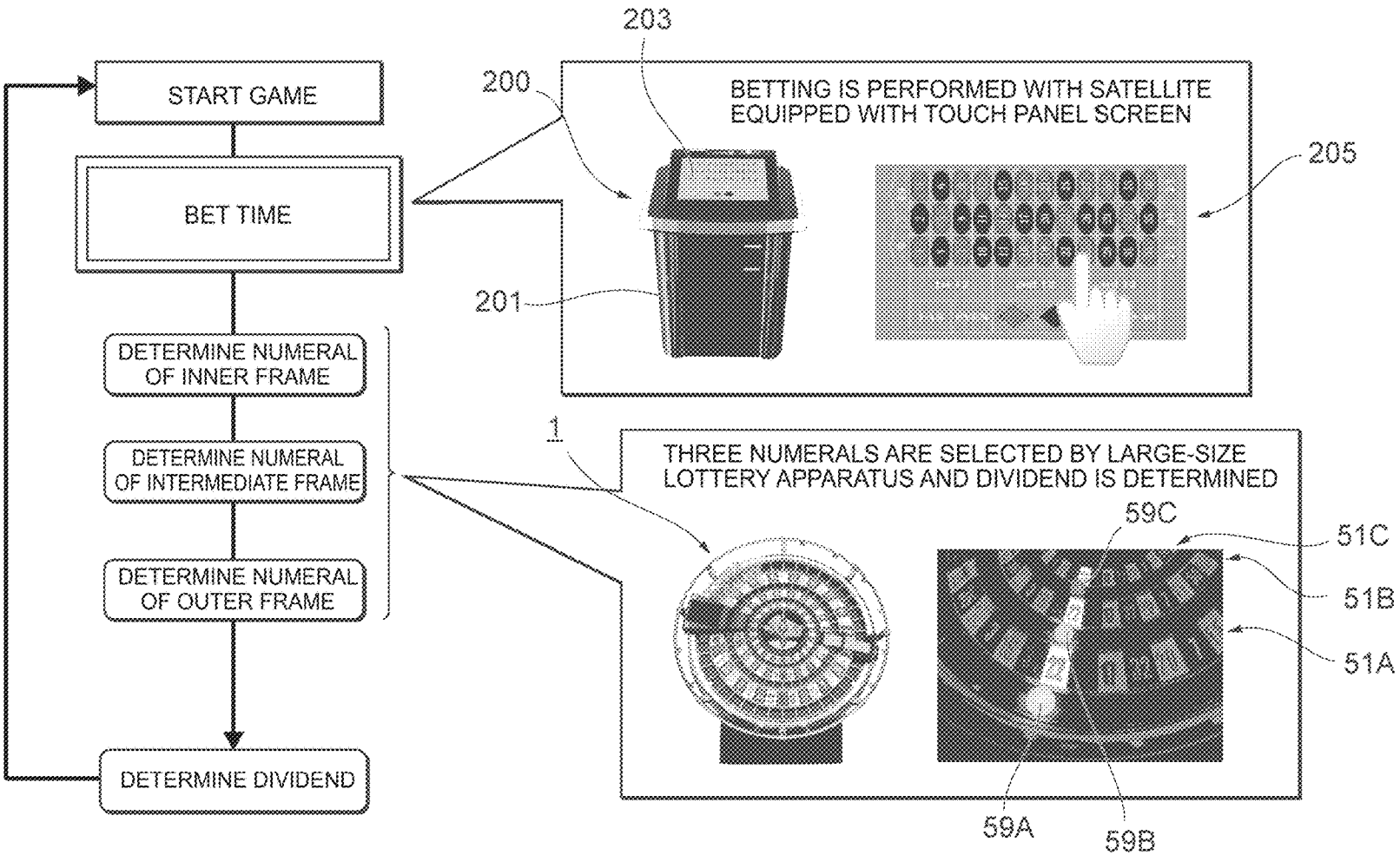
FIG. 3 is a diagram illustrating an example where a game flow in the roulette game system along with a state where a betting operation is performed with a station unit (satellite) at the time of betting and a state of a roulette body or the like in a roulette lottery apparatus at the time of carrying out a lottery.

Each station unit (which may be referred to as a satellite) 200 comprises an operation housing 201 allowing a player to input an operation (see FIG. 3 or the like). In the game system 100 according to this embodiment, plural operation housings 201 are arranged on the front side of the roulette lottery apparatus 1 so that movement of the roulette bodies 51 or the balls 59 in the roulette lottery apparatus 1 and a history display unit (display) 9 can be easily viewed from any operation housing 201 (see FIGS. 4 and 5 or the like). Each operation housing 201 is appropriately provided with a game table display unit 203 (see FIG. 3 or the like) comprising a touch panel screen disposed on the top surface thereof, an operation unit 205 used for a player to move a cursor to any cell in a game table displayed on the game table display unit 203 or to touch a cell of the touch panel to bet chips, and the like (see FIG. 3 or the like). The game table display unit 203 comprises a touch-panel liquid crystal display which is display means for outputting an image of a game field. For example, command keys are appropriately displayed on the liquid crystal display with the progress of a game and various command signals are input to a game control circuit by causing a player to directly touch the touch panel over the command keys with a hand. In the game system 100 according to this embodiment, a betting table in a roulette game is displayed on the game table display unit 203 (see FIG. 3).

The side monitor 500 appropriately displays a history of a game or the like.

The roulette lottery apparatus 1 is a main apparatus in the game system 100 and performs a physical lottery in a roulette game. The roulette lottery apparatus 1 according to this embodiment comprises plural roulette bodies, for example, three roulette bodies 51A, 51B, and 51C of large, middle, and small roulette bodies which are supported to be rotatable (see FIG. 4 or the like). These three roulette bodies (large roulette body, middle roulette body, and small roulette body) 51A, 51B, and 51C are annular rotating bodies having different diameters and are configured to rotate about a rotation center line Z which is an identical virtual axis. In the below description, when description is made in common without specifying any one of the plural roulette bodies, reference numeral 51 may be simply added thereto.

Figure 8:
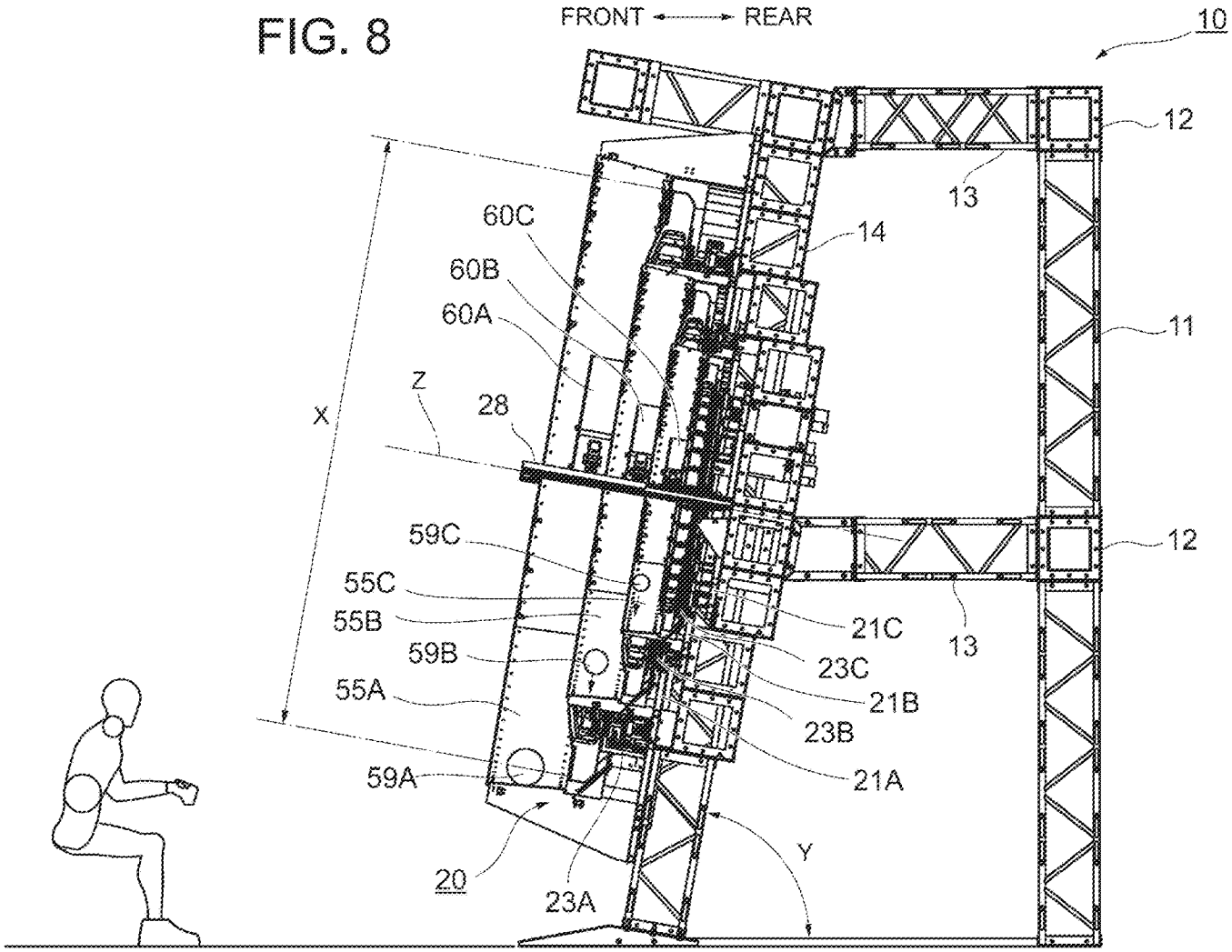
FIG. 8 is a right side view illustrating the internal structure of the roulette lottery apparatus.

The rotation plane of the three roulette bodies 51A, 51B, and 51C (the annular plane of the ball pockets 52 arranged in an annular shape) is raisable and the roulette bodies rotate about the virtual rotation center line Z which is horizontal or similar thereto (see FIG. 8 or the like). A general roulette board is configured to rotate about a vertical axis with the board surface set to be horizontal. On the contrary, in the roulette lottery apparatus 1 according to this embodiment, compared with the conventional apparatus, the rotation center line Z which is a virtual rotation axis is made to stand by Y° (for example, about 80°) and the surface (rotation plane) is similarly made to stand by Y° (see FIG. 8). The roulette lottery apparatus 1 having the configuration in which the surfaces of the roulette bodies 51A, 51B, and 51C stand in this way gives a novel impression to all spectators in addition to players.

In the roulette lottery apparatus 1 according to this embodiment, the roulette bodies 51A, 51B, and 51C are displaced along the rotation center line Z and are not flush with each other. In this way, since the roulette bodies 51A, 51B, and 51C are arranged in a stepped shape, that is, a mortar shape, and exhibit a sense of depth, the states or details of lotteries in the roulette bodies 51A, 51B, and 51C (such as the rotating states of the roulette bodies 51A, 51B, and 51C, movement of the ball 59, states in which the ball 59 enters into a ball pocket 52, and a winning number determined by allowing the ball 59 to enter into a ball pocket (the numeral of the number display section 53 corresponding to the ball pocket 52)) can be easily viewed from the front position of the roulette lottery apparatus 1 and can also be easily viewed from diagonal positions (see FIG. 5 or the like). Therefore, in the game system 100 according to this embodiment, the plural station units 200 can be arranged so that the lottery states or details in the roulette bodies 51 can be easily viewed from any position (see FIGS. 4 and 5).

Figure 4:
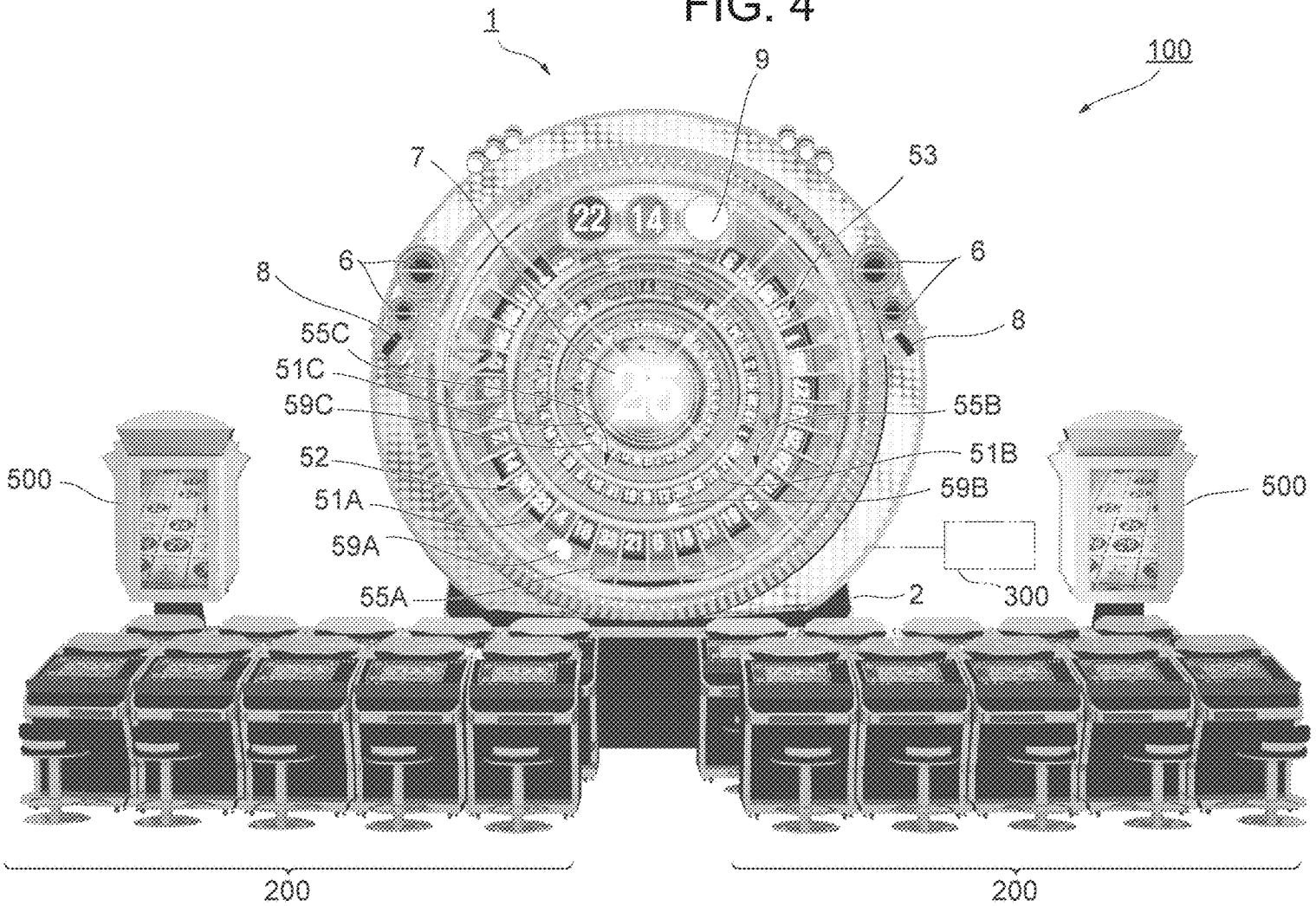
FIG. 4 is a diagram illustrating the entire roulette game system when viewed from the front side.
Figure 5:
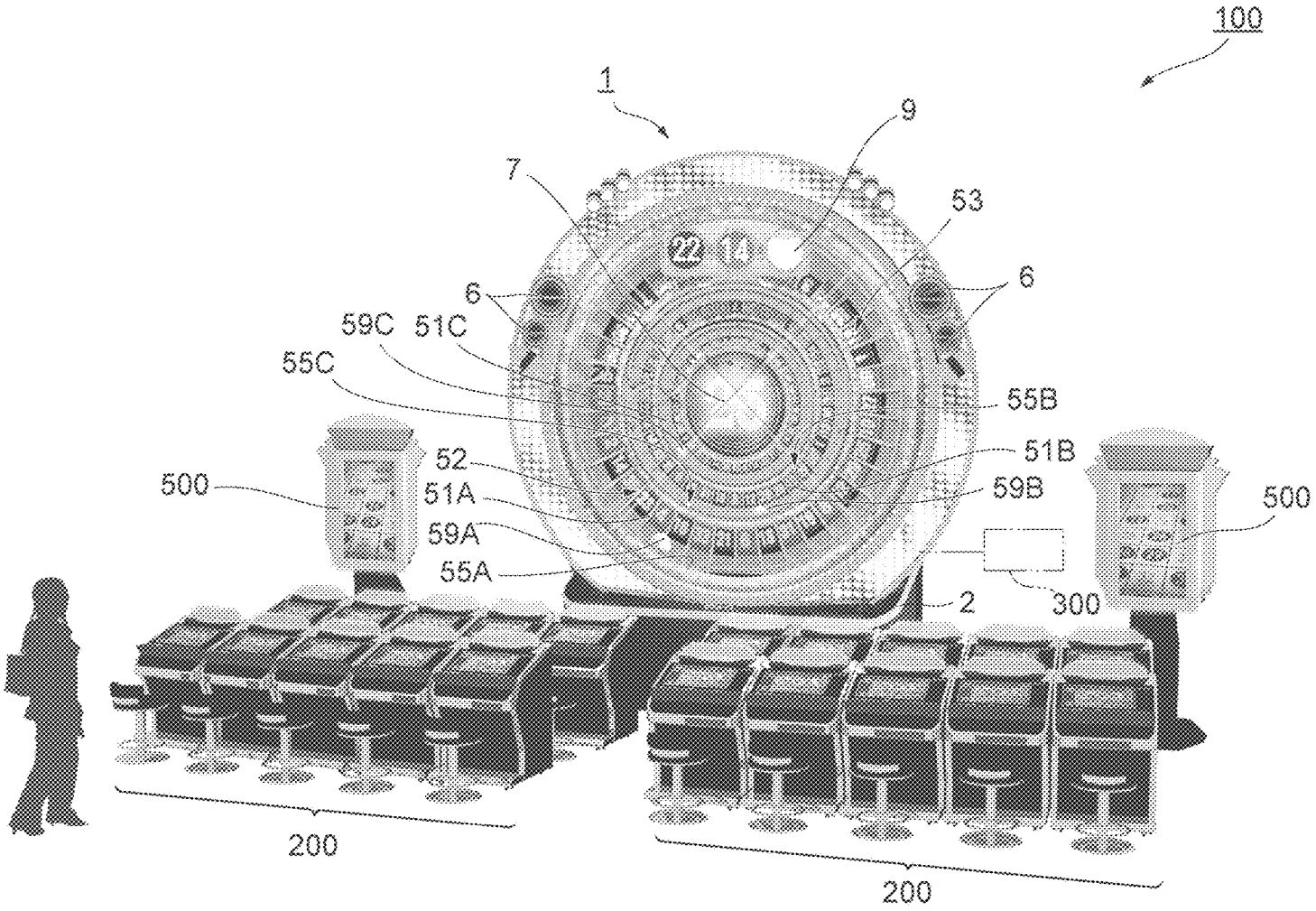
FIG. 5 is a diagram illustrating the entire roulette game system when viewed from the diagonal front side.

The specific configuration of the roulette lottery apparatus 1 will be described below (see FIG. 4 or the like).

The roulette lottery apparatus 1 according to this embodiment comprises a support frame 10, fixing members 20, rotating members 30, drive systems 40, roulette constituent members 50, ball release devices 60, ball reset devices 70, a control unit 80, and a storage unit 90 and further comprises a base 2, a camera (denoted by reference numeral 5 in FIG. 2), housing speakers 6, a central projector 7, and illumination devices 8. The control unit 80 and the storage unit 90 may be disposed in the roulette lottery apparatus 1 or may be disposed in the master unit 300, as long as they can exhibit their functions.

In the below description, when the configuration of any one (an outer large roulette body, an intermediate middle roulette body, or an inner small roulette body) of plural roulette bodies are described, signs such as A, B, and C are added to the reference signs thereof. On the other hand, when the roulette bodies are described in common without identifying any roulette body, the signs such as A, B, and C are not added thereto and only the reference numeral is described for explanation.

Figure 7:
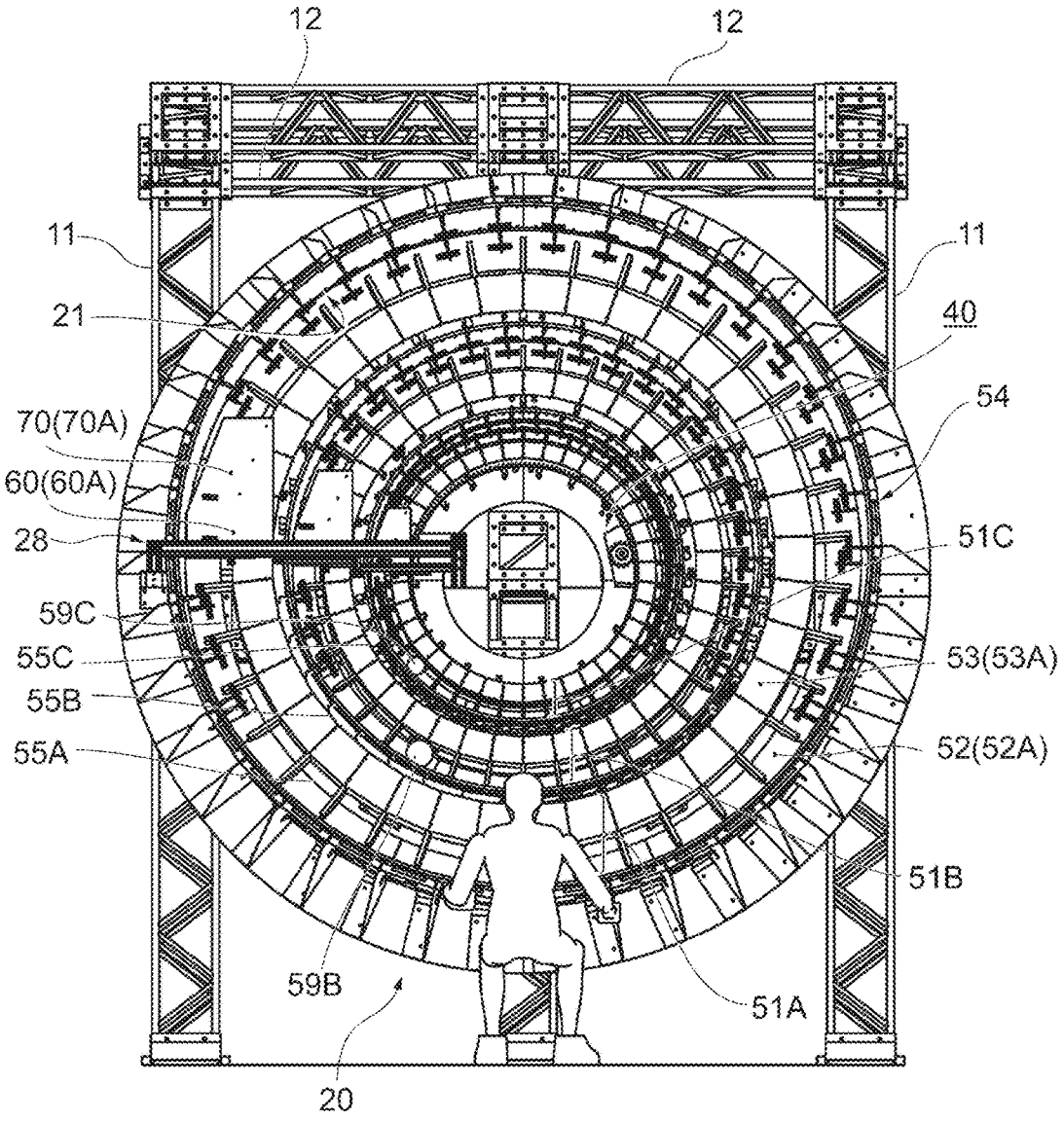
FIG. 7 is a front view illustrating an internal structure of the roulette lottery apparatus.

The support frame 10 serves as a support member supporting the fixing member 20. The support frame 10 according to this embodiment comprises a vertical frame 11 extending in the vertical direction, a horizontal frame 12 extending in the right-and-left direction, a front-and-rear frame 13 extending in the front-and-rear direction, and a tilt frame 14 slightly tilted about the vertical line (see FIGS. 7 and 8). The vertical frame 11 and the horizontal frame 12 are combined to form a door shape when viewed from the front side (see FIG. 7). The tilt frame 14 according to this embodiment is supported by the front-and-rear frame 13 in a state where it is tilted by 10° to the rear side about the vertical line (in other words, a state where it stands by 80° to the front side about the horizontal plane) (see FIG. 8). The tilt frame 14 supports the fixing members 20 from the rear side.

Each fixing member 20 is a member configured to rotatably support the rotating member 30 including the roulette body. The fixing member 20 according to this embodiment comprises a wheel rail base 21, brackets 22, a wheel rail 23, and joints 24 (see FIG. 17).

Figure 14:
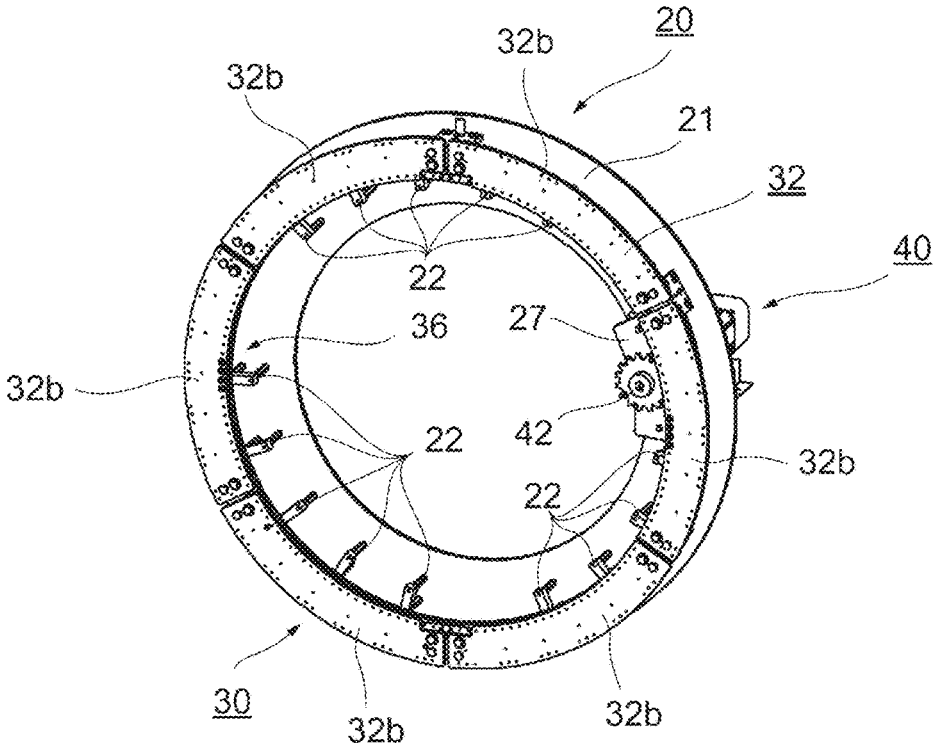
FIG. 14 is a perspective view illustrating a fixing member and a rotating member along with a drive system.
Figure 15:
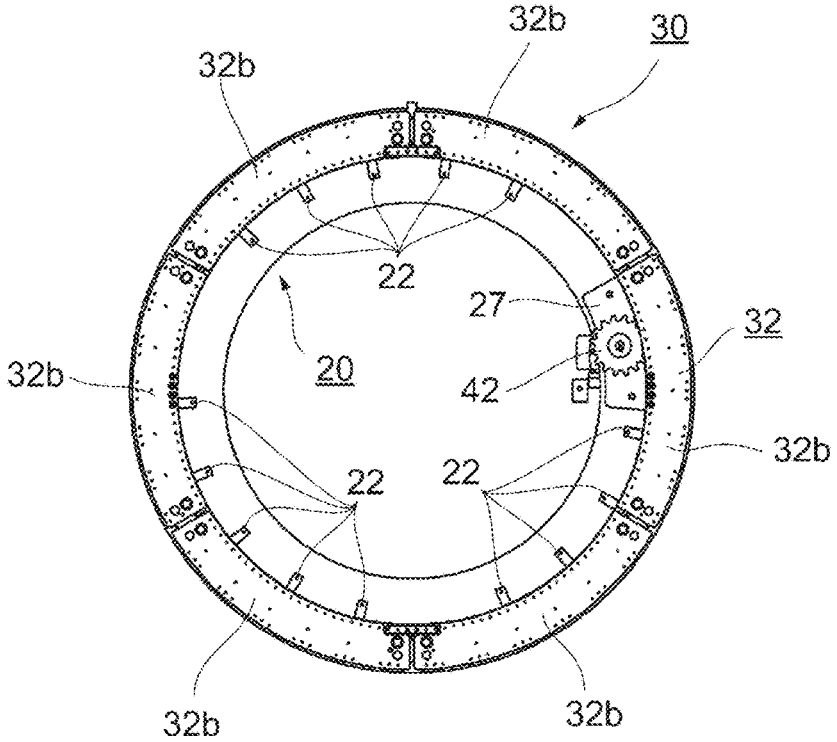
FIG. 15 is a front view illustrating the fixing member and the rotating member along with the drive system.

The wheel rail base 21 is a part serving as a base of the fixing member 20. The wheel rail base 21 according to this embodiment is formed of an annular steel plate (see FIG. 14 or the like). Here, the annular shape is an example, and the wheel rail base may not have an annular shape and is not particularly limited as long as it is suitable for circumferentially attaching plural brackets 22. The wheel rail base 21 is fixed to the front surface side (side on which players are located) of the support frame 10 (see FIGS. 7 and 8 or the like).

The bracket 22 is a member holding the wheel rail 23. In the roulette lottery apparatus 1 according to this embodiment, plural brackets 22 are arranged in an annular shape on the wheel rail base 21 and the wheel rail 23 is held by the brackets 22 arranged in an annular shape. From the viewpoint of evenly holding the wheel rail 23, it is preferable for the plural brackets 22 to be arranged at equal intervals.

For example, the brackets 22 are installed to be movable in the radial direction and it is preferable for the positions of the brackets in the radial direction to be adjustable. As will be described later, the possibility that the wheel rail 23 in this embodiment will be completely circular is very low and there is a possibility that unevenness in shape by products will occur. When the wheel rail 23 should be held, it is considered that the plural brackets 22 are individually movable in the radial direction. Then, whatever the wheel rail 23 is and in whatever direction the wheel rail 23 is held (in other words, at what clock position one point on the wheel rail 23 is located), it is possible to handle the situations by adjusting the individual positions of the brackets. The positions of the brackets 22 at which the wheel rail 23 is held have only to be shifted in the radial direction.

For example, each bracket 22 in this embodiment can be shifted with the length of a long hole as a stroke length along the long hole. The position thereof can be fixed by fastening a bolt to an appropriate position in the stroke range.

Figure 10:
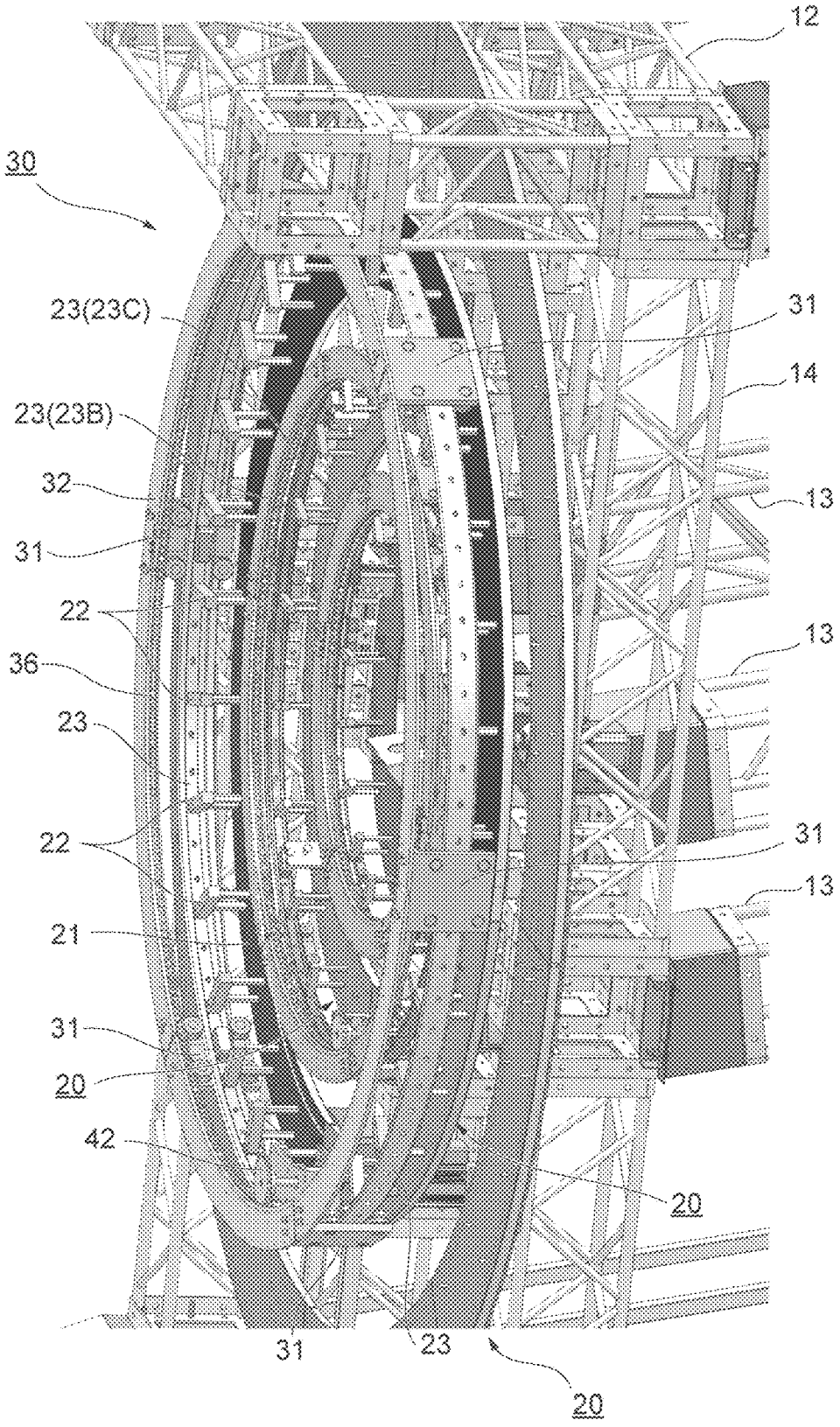
FIG. 10 is a perspective view illustrating configurations of a support frame, a fixing member, and a rotating member of the roulette lottery apparatus.
Figure 16:
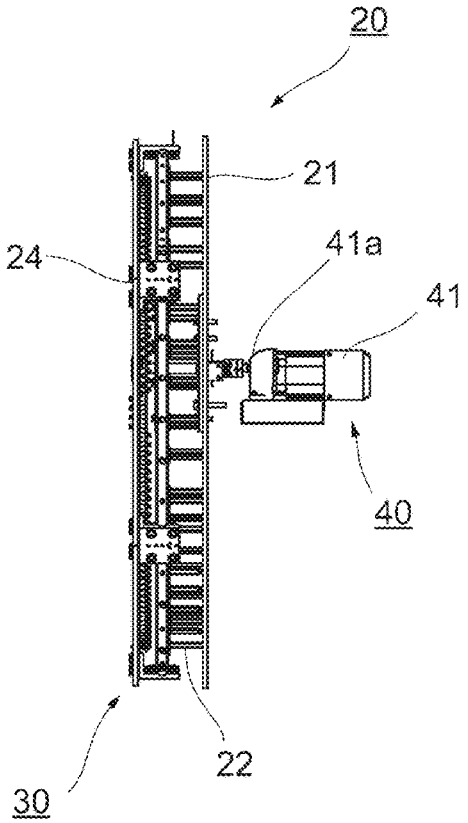
FIG. 16 is a side view illustrating the fixing member and the rotating member along with the drive system.
Figure 20:
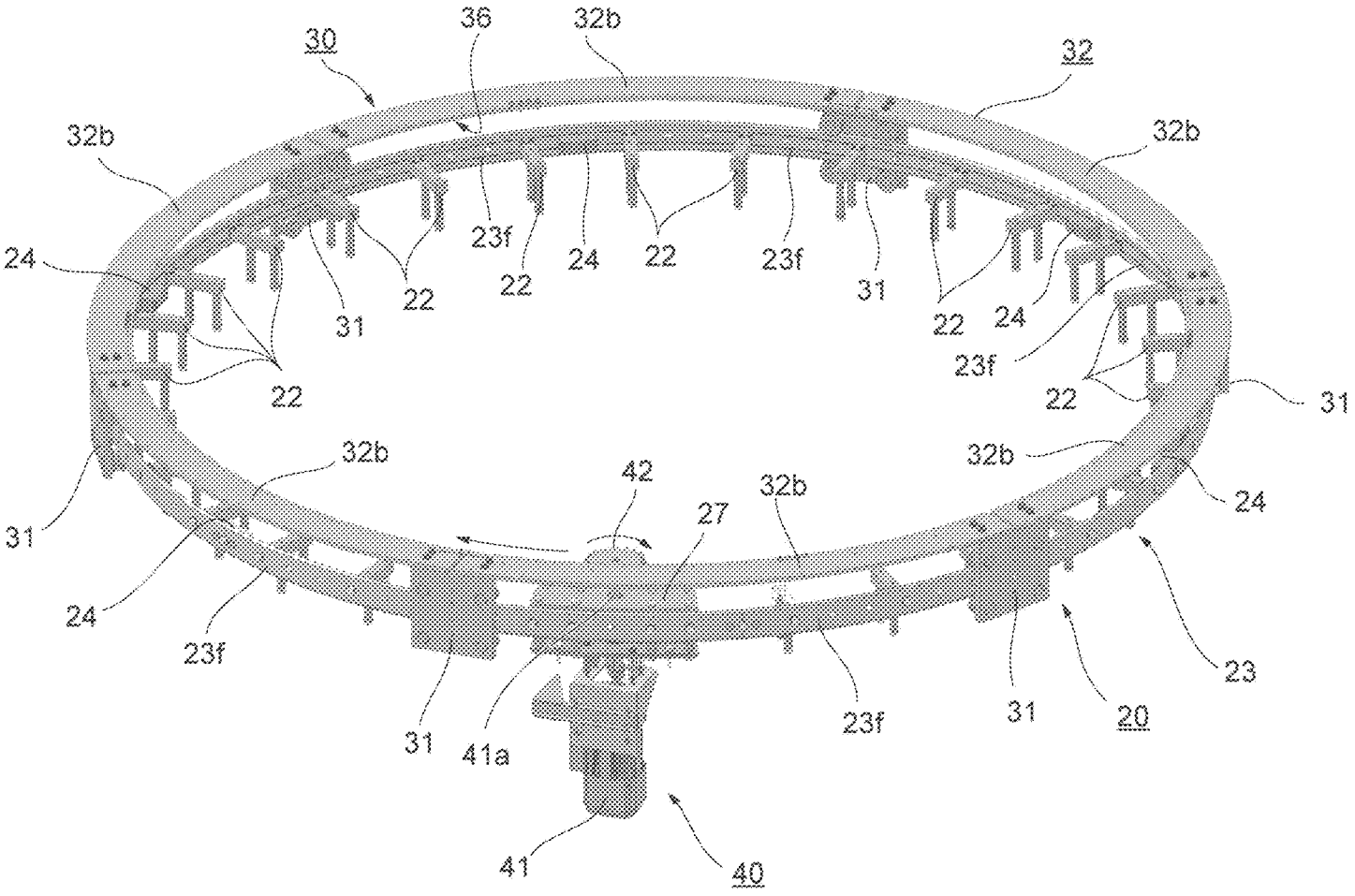
FIG. 20 is a perspective view illustrating the fixing member and the rotating member along with the drive system.

The wheel rail 23 is an annular member fixed to the wheel rail base 21 with the brackets 22 and constitutes an annular guide rail when the rotating member 30 rotates (see FIGS. 10 and 16 and the like). The wheel rail 23 according to this embodiment is formed by connecting six arc-like fixing members **23*f* with a central angle of 60°, which are obtained by dividing an annular member into six parts, in an annular shape with total six joints 24 (see FIGS. 18 and 20** and the like).

In the roulette lottery apparatus 1 according to this embodiment (of which the specific size will be described later) which has a large size and which employs the roulette bodies 51 being raisable, particular problems may occur when the respective roulette bodies 51 are rotatably supported. That is, the problems are as follows.

When the roulette bodies 51 having large weights are supported with one center axis (spindle), strength corresponding thereto is required and an increase in size and weight is necessarily caused. When multiple (for example, three) roulette bodies 51 are arranged coaxially, this problem is further actualized.

When the plural roulette bodies 51 are rotatably held without using the center axis (spindle), for example, means for rotatably holding the roulette bodies 51 such as an annular guide can be used. However, when the annular guide capable of holding the very large roulette bodies 51 is molded, it is difficult to make the annular guide completely circular and the molding cost increases.

Even when a unified annular guide which is almost completely circular is molded, labors and costs are required for carrying or assembling thereof.

In consideration of such various points, in this embodiment, the wheel rail 23 is formed by combining plural arc-like fixing members **23*f* at wheel rail junctions. For example, in this embodiment, six arc-like fixing members 23*f* with a central angle of 60° obtained by dividing an annular member into six parts are connected in an annular shape using six joints 24 to form the wheel rail 23. When end faces of the plural arc-like fixing members 23*f* are bonded to each other to form an annular shape, the annular shape is not completely circular, but a deviation in circumferential length by products is small and the circumferential length is considered to be almost constant by using the arc-like fixing members 23*f* having the same arc shape. Therefore, even when the shape is strained, it is possible to form the wheel rail 23** which is approximate to a complete circle and which has an almost constant circumferential length.

In other words, in this embodiment, when the sizes, structures, and the like of the roulette lottery apparatus 1 and the roulette bodies 51 are employed, it is difficult to avoid occurrence of strain due to an attachment error and thus the fixing member 20 is formed on the premise that the wheel rail 23 is not completely circular. In the rotating member 30 rotationally moving along the noncircular wheel rail 23 in which a strain is generated in this way, the carriage 31 can be made to smoothly rotate along the wheel rail 23 by constructing a strain absorbing mechanism as will be described later.

In addition, since the roulette bodies 51 are configured to rotate along the annular rail to make a central rotation axis (spindle) unnecessary, a monitor (for example, a central projector 7) or the like may be arranged in the center of the rotating roulette bodies 51 in the roulette lottery apparatus 1 according to this embodiment.

Since the arc-like fixing members **23*f* according to this embodiment are obtained by bending a band-like member formed of a thin plate in an arc shape, it is advantageous in terms of a decrease in weight. In this embodiment, the carriage 31 is configured to move by pinching the wheel rail 23 including the arc-like fixing members 23*f*** from both sides and thus it is easy to secure strength.

Figure 17:
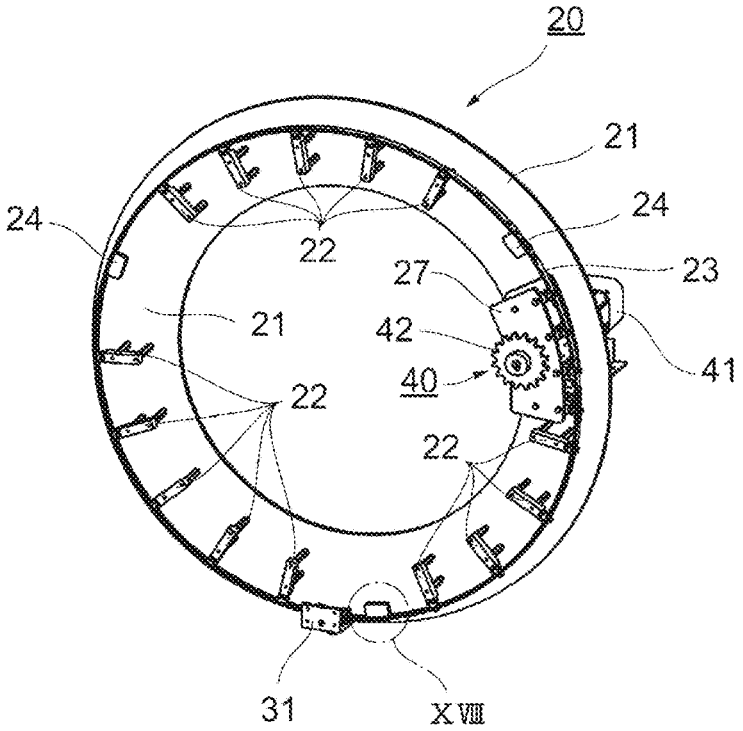
FIG. 17 is a perspective view illustrating the fixing member along with the drive system.
Figure 18:
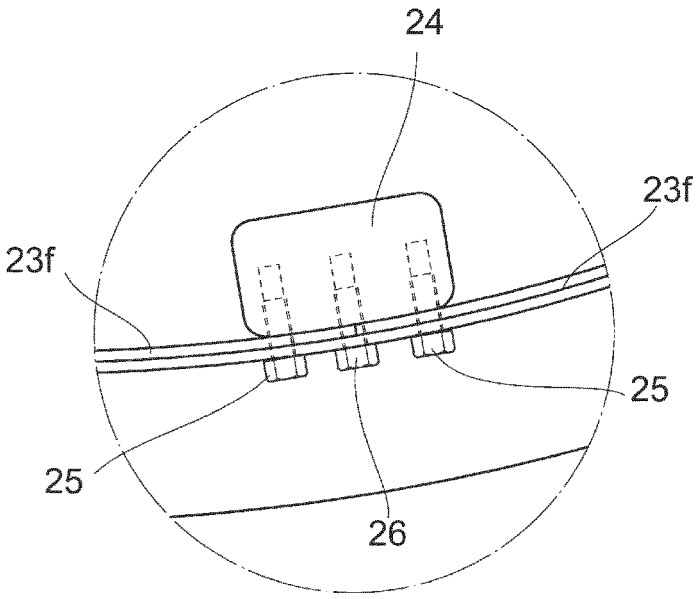
FIG. 18 is an enlarged view of a wheel rail junction indicated by reference sign XVIII in FIG. 17.

FIG. 18 is an enlarged view of a wheel rail junction indicated by reference sign XVIII in FIG. 17. The joint 24 is a member connecting the arc-like fixing members **23*f* to each other. The joint 24 according to this embodiment connects the ends of the neighboring arc-like fixing members 23*f* to each other from the inner circumference side in a state where the end faces of the arc-like fixing members come in contact with each other. As the joint 24, for example, a joint connecting the arc-like fixing members 23*f* by inserting screws 25 into through-holes of the arc-like fixing members 23*f* from the outer circumference side and fastening the screws to the joint body on the inner circumference side can be used. The joint 24 according to this embodiment has a shape and a size enough not to interfere with the movement of the carriage 31 revolving along the wheel rail 23**.

Figure 19:
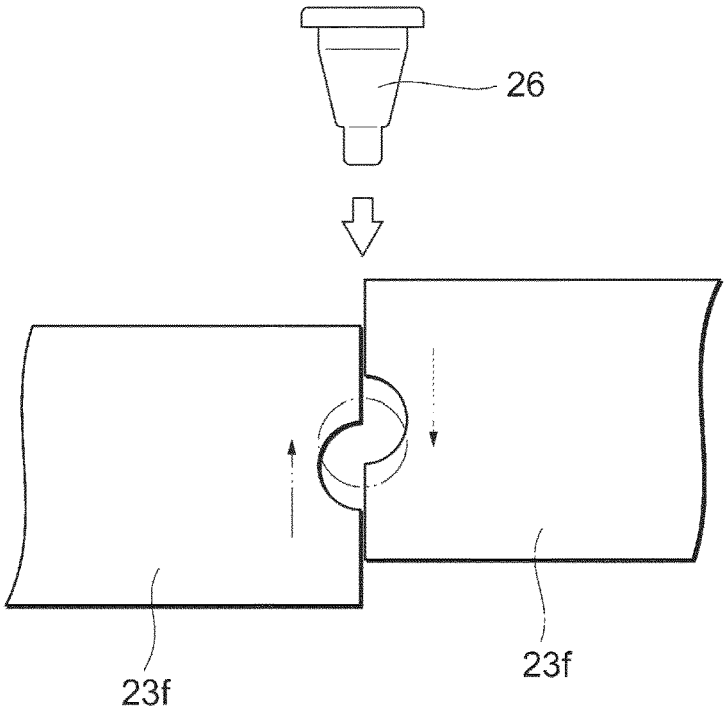
FIG. 19 is a diagram illustrating an operation of an adjustment screw in the wheel rail junction.

It is preferable that the joint 24 is configured to correct the relative misalignment between the end faces while the end faces come in contact with each other, for example, by fastening an adjustment screw 26 having a taper shape. For example, when a semicircular hole is formed in each end face of the arc-like fixing members 23*f* and the adjustment screw 26 having a taper shape is inserted into the hole to form a circle with a pair of semicircular holes, it is possible to correct the misalignment between both end faces (misalignment in the front-and-rear direction of the roulette lottery apparatus 1 in this case) (see FIG. 19).

The roulette lottery apparatus 1 includes three fixing members 20 having the above-mentioned configuration (see FIG. 10 and the like). The three fixing members 20 are configured to have different sizes corresponding to the large roulette body 51A, the middle roulette body 51B, and the small roulette body 51C, respectively.

Figure 12:
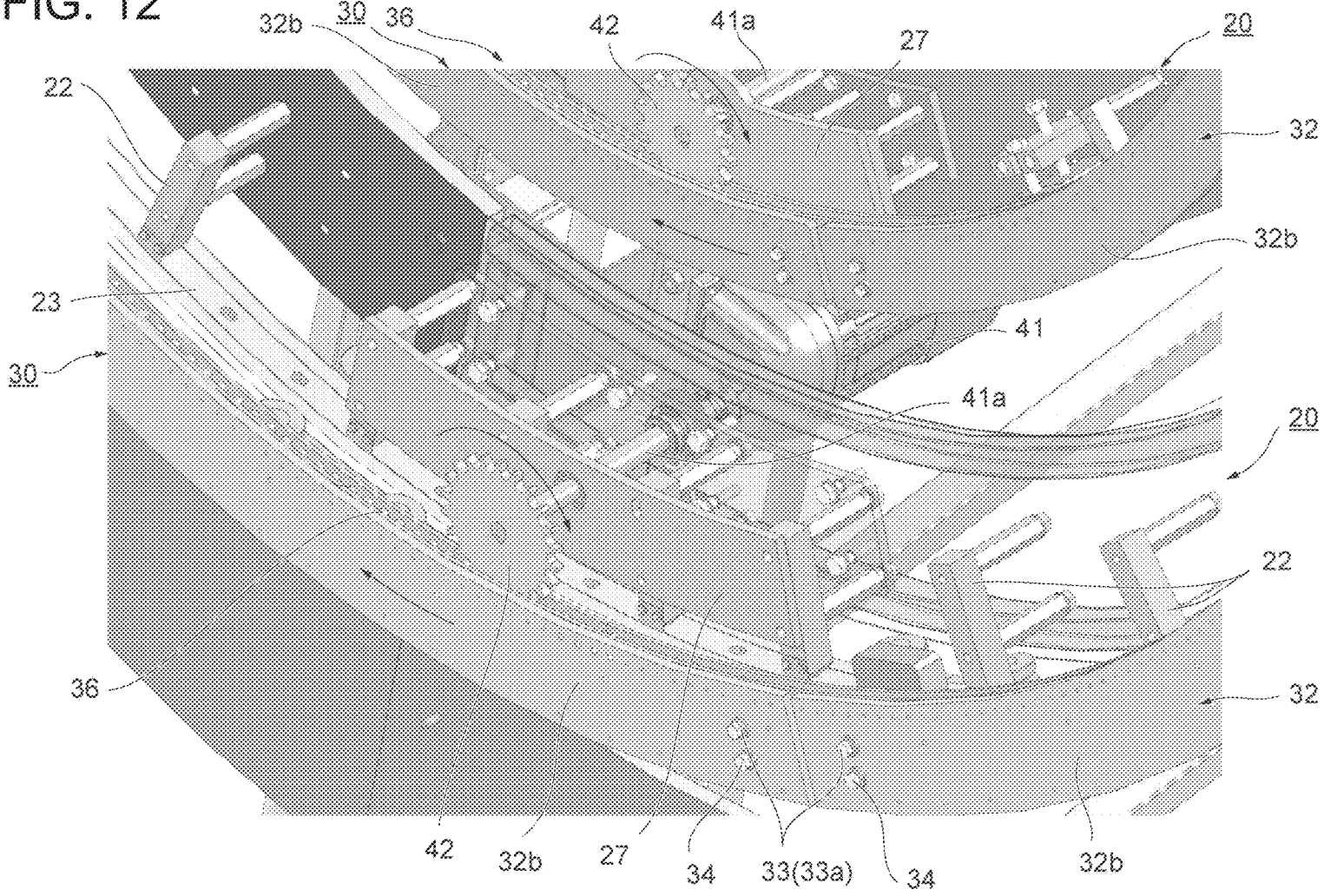
FIG. 12 is an enlarged view illustrating a configuration around a drive system of a rotating member.

The output bearing member 27 is a member serving as a bearing of an output shaft 41*a* of a roulette body drive motor 41 as an output source. The output bearing member 27 according to this embodiment is attached to a part of the fixing member 20, for example, the wheel rail 23 or the like and serves as a bearing of the output shaft 41*a* of the roulette body drive motor 41. The output bearing member 27 according to this embodiment is formed of a pair of plate-like members facing each other and having holes through which the output shaft 41*a* passes (see FIG. 12 and the like), but this is only a preferable example and other configurations may be employed.

The rotating member 30 is a member rotating along the fixing member 20 to cause the roulette body 51 to rotate. The rotating member 30 according to this embodiment comprises a carriage 31, an annular rotating body 32, and a pin gear wheel 36 (see FIG. 20 and the like).

Figure 22:
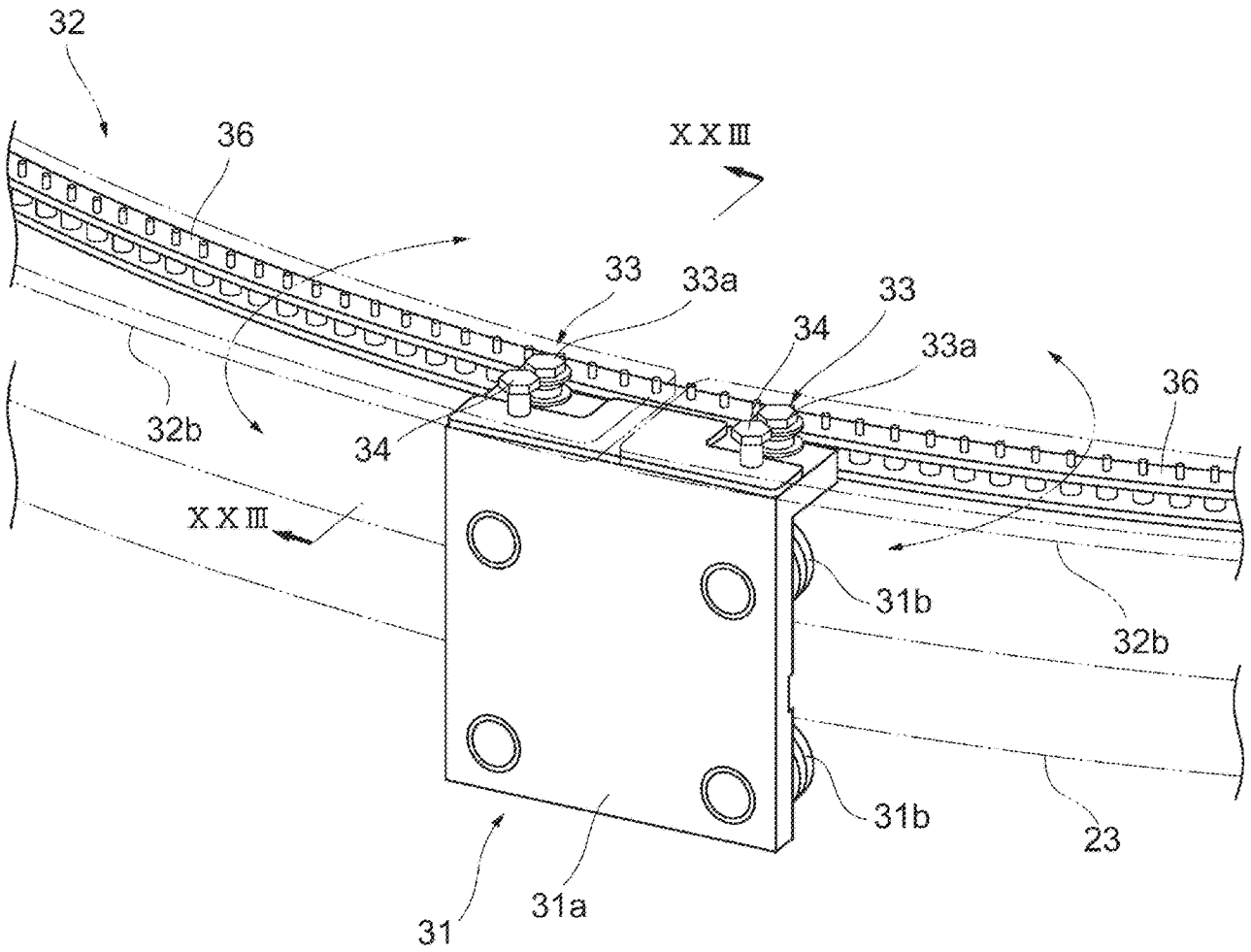
FIG. 22 is an enlarged view illustrating an inner carriage of the rotating member and a neighboring part thereof.

The carriage 31 is a member disposed to be movable along the wheel rail (guide rail) 23 while supporting the annular rotating body 32. The carriage 31 according to this embodiment comprises a base 31*a* and rollers 31*b* and is configured to move on the outer circumferential surface side of the wheel rail 23 (see FIG. 20 and the like). The annular rotating body 32 is attached to the carriage 31 so as to be relatively rotatable (see FIG. 22 and the like).

The base 31*a* is formed of a plate-like member. Total four rollers 31*b* of two pairs are arranged at four corners of the base 31*a*. A V-shaped groove is formed in each roller 31*b* (see FIG. 23) so as not to drop from the edge of the wheel rail 23. The rollers 31*b* are arranged to pinch both edges of the wheel rail 23 using the V-shaped groove. Since the wheel rail 23 is pinched between two pairs of rollers 31*b* arranged in the progressing direction, the carriage 31 can progress while stabilizing the posture without causing yawing in the progressing direction (see FIG. 20 and the like).

The annular rotating body 32 is a member disposed to form a circular shape as a whole and to constitute the rotating member 30 and formed of, for example, aluminum. The annular rotating body 32 according to this embodiment are formed by six arc-like rotating members 32*b* with a central angle of 60° obtained by dividing an annular plate-like member into six parts (see FIG. 20 and the like). Both ends of each arc-like rotating member 32*b* are rotatably held by the carriage 31.

A structure for rotatably holding the arc-like rotating members 32*b* in the carriage 31 will be described below in detail (see FIG. 23 and the like).

The arc-like rotating members 32*b* are attached to the base of the carriage 31 so as to be rotatable about the rotation axis 33. More specifically, a pin 33*a* passes through a through-hole 32*c* formed in the arc-like rotating member 32*b* and the tip of the pin 33*a* is inserted into a pin hole 31*c* of the base 31*a*. A washer 33*b* is interposed between the head of the pin 33*a* and the arc-like rotating member 32*b*. A sleeve 33*c* is fitted onto the outer circumference of the pin 33*a*. By employing this configuration, the arc-like rotating member 32*b* is rotatable (or swingable) in the right-and-left direction (more specifically, a swinging direction to the inner circumference side and the outer circumference side with respect to the tangent direction of the annular rotating body 32) about the center axis (that is, rotation axis 33) of the pin 33*a* (see FIGS. 21 and 22).

Figure 23:
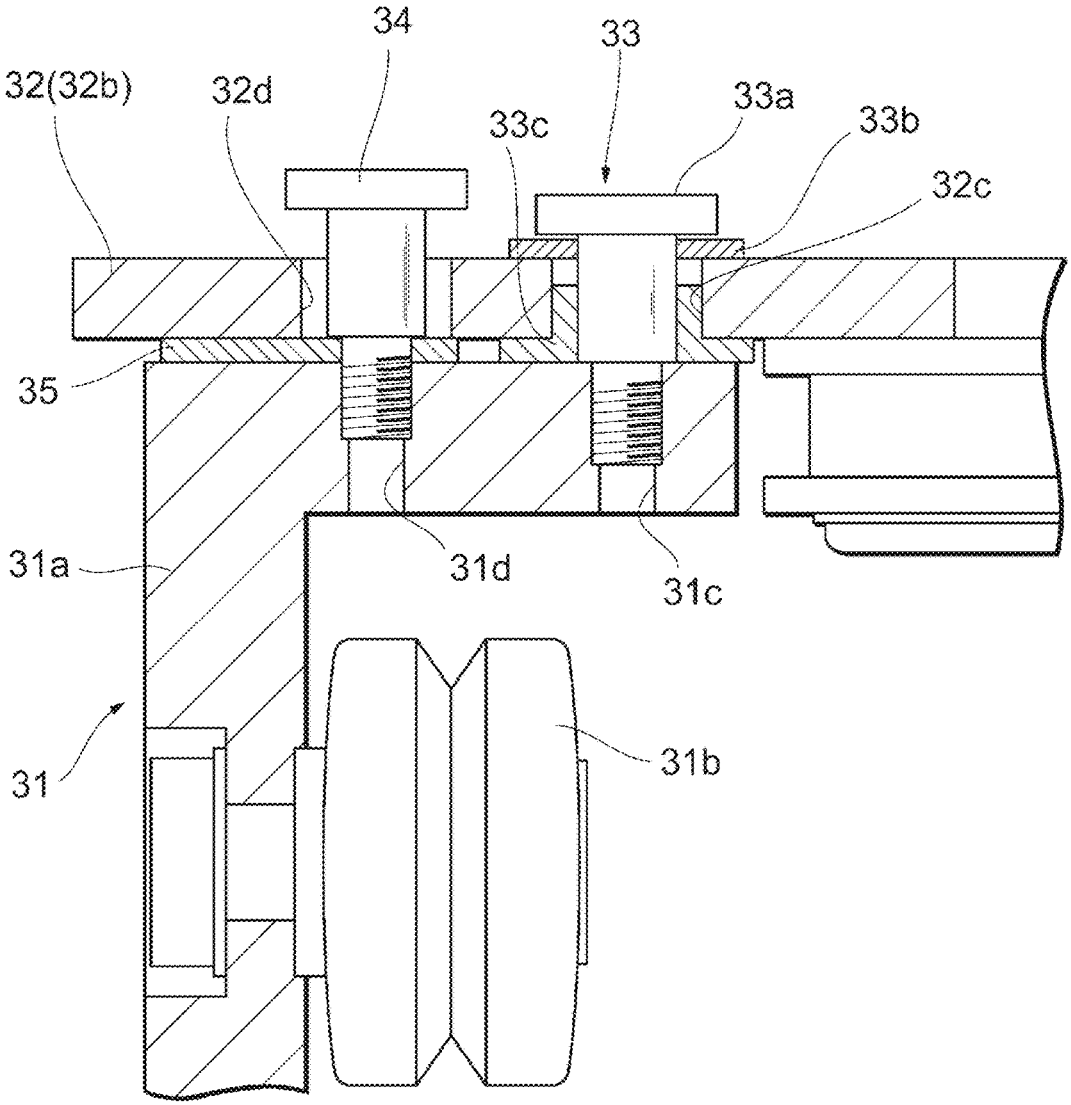
FIG. 23 is a partial cross-sectional view of a carriage and a neighboring part thereof taken along line XXIII-XXIII of FIG. 22, which illustrates the strain absorbing mechanism.

In the arc-like rotating member 32*b*, another through-hole 32*d* is formed in the vicinity of the through-hole 32*c*, and a stopper pin 34 passes through the through-hole 32*d* (see FIG. 23). The tip of the stopper pin 34 is inserted into another pin hole 31*d* formed in the arc-like rotating member 32*b*. The diameter of the head of the stopper pin 34 is larger than that of the through-hole 32*d* and the arc-like rotating member 32*b* is prevented from dropping from the carriage 31 even when the pin 33*a* is pulled out in the course of rotating movement. The through-hole 32*d* is larger than the shaft portion of the stopper pin 34 and a clearance (looseness) is formed therebetween. The stopper pin 34 or the through-hole 32*d* does not interfere with the relative rotation (swinging) of the arc-like rotating member 32*b* to the carriage 31, but regulates a rotatable (swingable) range (the length of the swinging stroke) depending on the size (length) of the through-hole 32*d*.

A lubricating member 35 is interposed between the base 31*a* of the carriage 31 and the arc-like rotating member 32*b* (see FIG. 23). The lubricating member 35 serves to further lubricate the relative rotating (swinging) operation of the arc-like rotating member 32*b* relative to the carriage 31 and is formed of, for example, a porous member in which lubricant is impregnated. From the viewpoint that the relative rotating (swinging) operation of the arc-like rotating member 32*b* relative to the carriage 31 is more lubricated, the washer 33*b* and the sleeve 33*c* also serve as the lubricating member (see FIG. 23).

Figure 21:
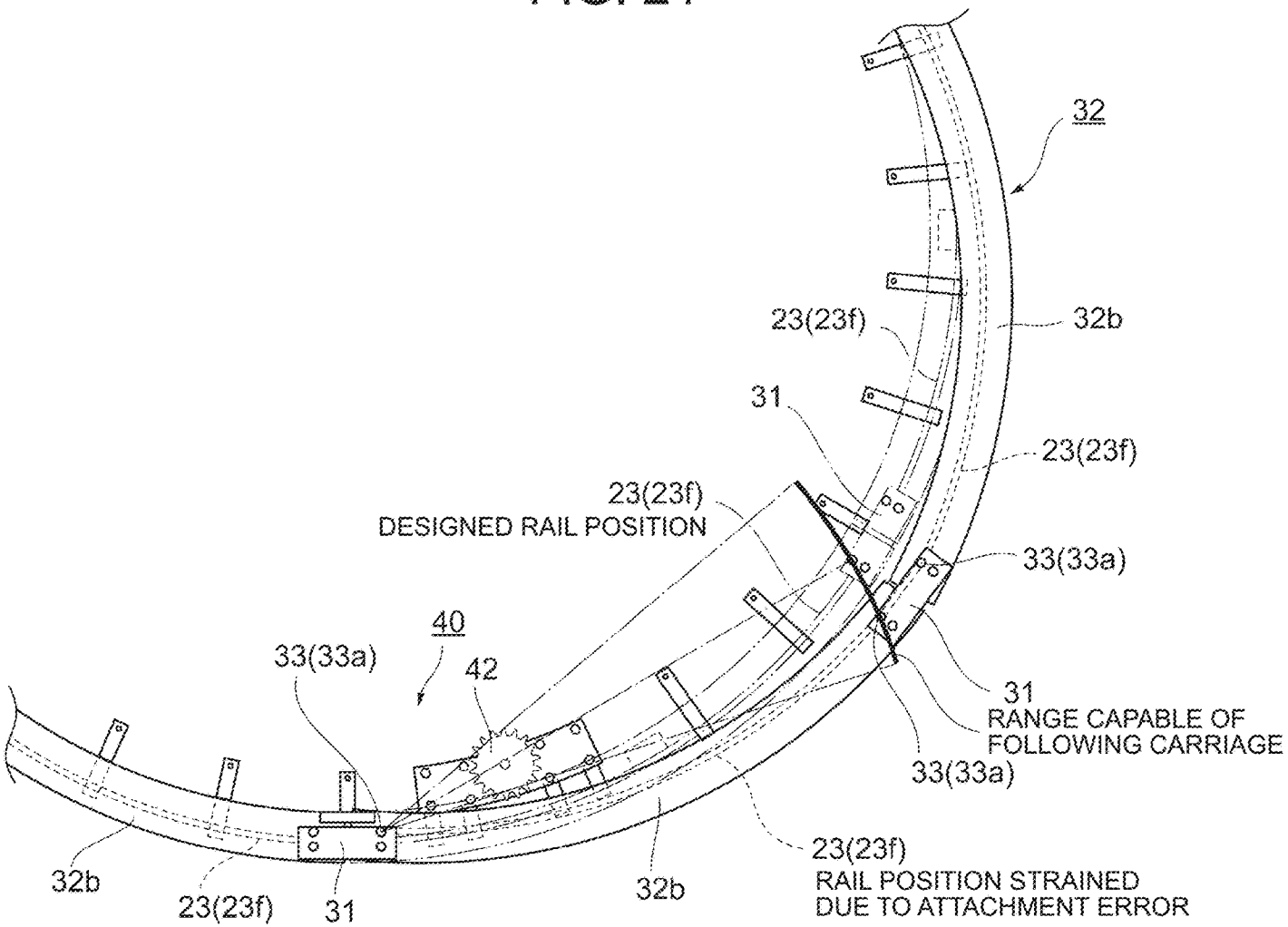
FIG. 21 is a diagram illustrating a strain absorbing mechanism in the fixing member and the rotating member.

As described above, a mechanism (strain absorbing mechanism) enabling to absorb strain is configured by holding the arc-like rotating member 32*b* so as to be rotatable relative to the carriage 31 (see FIG. 21). That is, even when the actual position of the wheel rail 23 is misaligned with the designed position (complete circle) of the wheel rail 23 due to strain based on an attachment error, the arc-like rotating member 32*b* relatively rotates in a predetermined range relative to the carriage 31 and it is thus possible to track the misaligned orbit of the carriage 31. In brief, when the orbit of the carriage 31 is not completely circular but is not severely strained, the arc-like rotating members 32*b* track the movement of the carriage 31 to exclude the influence of the strain. By employing this strain absorbing mechanism, the smooth revolving movement of the carriage 31 on the wheel rail 23 is not hindered.

The rotating member 30 is provided with a driving force receiving section receiving the drive force of the drive system 40. In the roulette lottery apparatus 1 according to this embodiment, the drive force receiving section is formed of the pin gear wheel 36 disposed on the inner circumference of the annular rotating body 32 (see FIGS. 14 and 22 and the like). The pin gear wheel 36 includes, for example, a pair of rails and plural pins arranged at equal intervals between the rails (see FIG. 22 and the like). In the roulette lottery apparatus 1 according to this embodiment, the pin gear wheel 36 is disposed on the inner circumference side of the annular rotating body 32.

The rotating member 30 having the above-mentioned configuration constitutes the rotating roulette body 51. In the roulette lottery apparatus 1 according to this embodiment, three types of roulette bodies of the large roulette body 51A, the middle roulette body 51B, and the small roulette body 51C having different diameters are configured to be coaxial about the rotation center line Z and to be displaced along the line direction of the rotation center line Z and constitute so-called triple ring rotating bodies.

The drive system 40 comprises a roulette body drive motor 41, a sprocket 42, and an encoder 43.

The roulette body drive motor 41 is a drive source for allowing the rotating member 30 to rotate. The roulette body drive motor 41 according to this embodiment causes the rotating member 30 to rotate via the sprocket 42 disposed on the output shaft 41*a* and the pin gear wheel 36.

The sprocket 42 is disposed on the output shaft 41*a* of the roulette body drive motor 41 and transmits the drive force of the roulette body drive motor 41 to the pin gear wheel 36. The output shaft 41*a* is received by the output bearing member 27 attached to the wheel rail 23 (see FIG. 12 and the like).

The encoder 43 is a member for encoding the degree of rotation of the rotating member 30. In this embodiment, the rotation shaft of the roulette body drive motor 41 is provided with the encoder 43 and the degree of rotation of the rotating member 30 is detected on the basis of the degree of rotation of the roulette body drive motor 41 (see FIG. 12 and the like). As described above, in the roulette lottery apparatus 1 according to this embodiment, since the drive force is transmitted to the annular rotating body 32 so as to rotate via the sprocket (pin gear) 42 and the pin gear wheel 36, slip does not occur between the sprocket 42 and the pin gear wheel 36. By reading the degree of rotation of the rotation shaft of the roulette body drive motor 41, that is, the degree of rotation of the sprocket 42, it is possible to detect the degree of rotation of the annular rotating body 32 which corresponds to the degree of rotation of the sprocket 42 in a one-to-one relationship.

As another configuration for detecting the degree of rotation of the rotating member 30, the annular rotating body 32 may be provided with an encoder and the degree of rotation of the rotating member may be directly detected using the encoder rotating together with the annular rotating body 32. However, when this configuration is employed and the rotation angle of the rotating member 30 should be detected in more detail, it is necessary to increase the number of encoders (for example, the number of protrusions or concave and convex portions to be encoded) by as much. In this regard, in the roulette lottery apparatus 1 according to this embodiment, it is possible to accurately detect the degree of rotation of the annular rotating body 32 using only the encoder 43 disposed on the output shaft 41*a* of the roulette body drive motor 41.

The same number of drive systems 40 having the above-mentioned configuration as the number of rotating members 30 are provided. In this embodiment, the large, middle, and small roulette bodies (the large roulette body is denoted by reference sign 51A, the middle roulette body is denoted by reference sign 51B, and the small roulette body is denoted by reference sign 51C in FIG. 6 and the like) are provided with total three drive systems 40, respectively.

Figure 11:
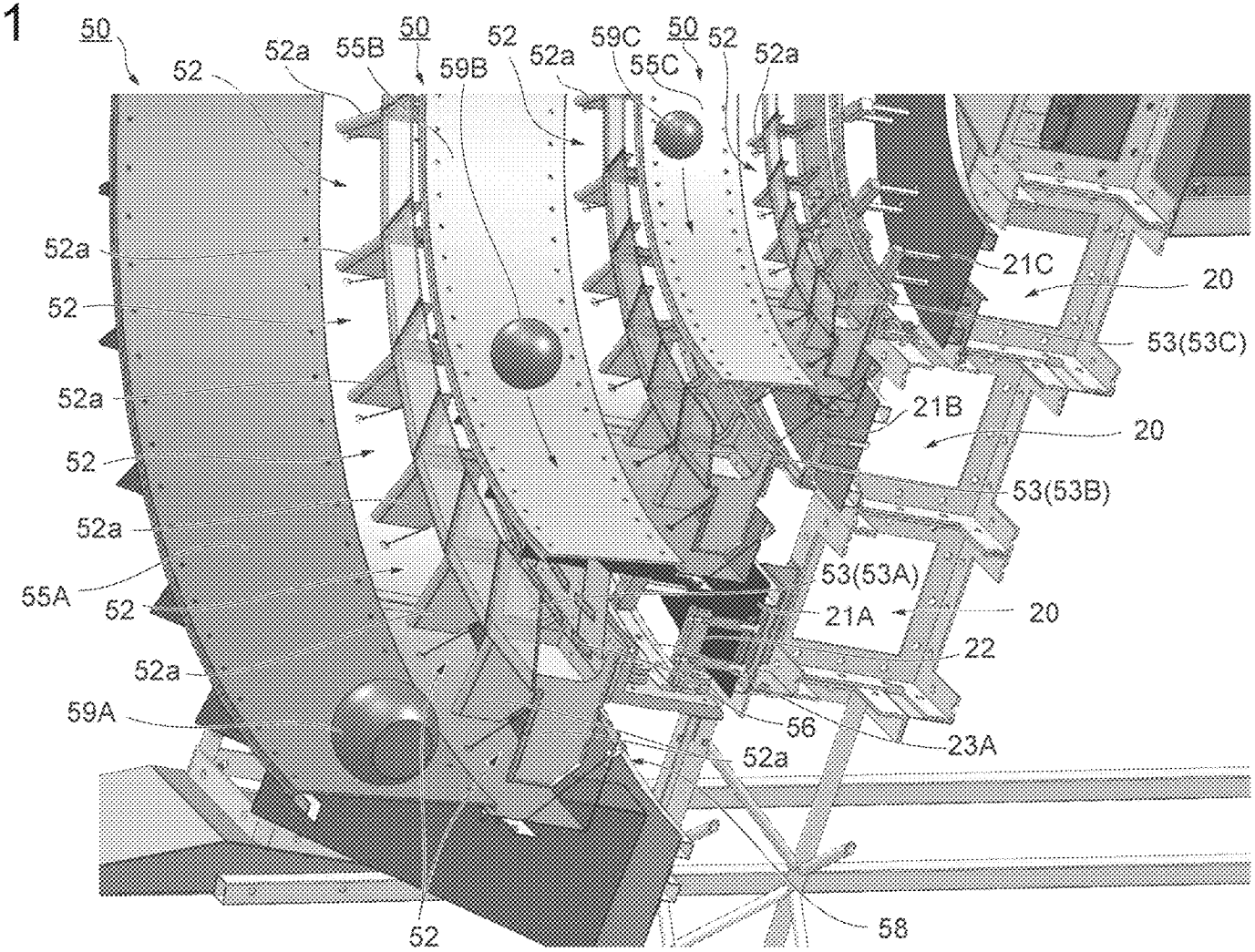
FIG. 11 is a diagram illustrating a detailed configuration around a ball rail, where a part of FIG. 9 is enlarged.

The large roulette body (large wheel) 51A, the middle roulette body (middle wheel) 51B, and the small roulette body (small wheel) 51C are formed of roulette constituent members 50, respectively. The large roulette body 51A, the middle roulette body 51B, and the small roulette body 51C are different in the size or the attachment position, but the roulette constituent members 50 in the respective roulette bodies (wheels) have the same basic configuration. The roulette constituent members 50 will be first described below. However, in the below description of the roulette constituent members 50, the roulette constituent members which are common to the large, middle, and small roulette bodies and which do not need to be distinguished from each other will be described without adding branch numbers such as A, B, and C, and the roulette constituent members will be described with the branch numbers such as A, B, and C appropriately added thereto so as to distinguish the large, middle, and small roulette bodies when distinction of the large, middle, and small roulette bodies is preferable in the drawings (see FIG. 11 and the like).

The roulette constituent members 50 comprise a roulette body 51, ball pockets 52, ball sensors 58 (see FIG. 11), number display sections 53, ball rotation-directing illuminations 54 (see FIG. 7), a ball rail 55, and LEDs 56.

The roulette body 51 is formed of a rotating annular member. The roulette body 51 in this embodiment is formed of a wheel-like member attached to the front surface side of the rotating member 30. The ball pockets 52 and the number display sections 53 are formed in the roulette body 51 (see FIG. 11 and the like).

The ball pockets 52 are formed by plural spaces formed in the roulette body 51 so that a ball 59 released from a ball release device 60 falls (enters) thereinto. In the roulette lottery apparatus 1 according to this embodiment, each ball pocket 52 is formed by a space defined by partitioning blades 52*a*. A winning number of the roulette is determined in advance for each ball pocket 52, and the winning number is determined depending on the ball pocket 52 into which the ball 59 falls.

The partitioning blades 52*a* are disposed on the outer circumference of the roulette body 51 so as to rotate along with the roulette body 51. The number of partitioning blades 52*a* is equal to the number of ball pockets 52. The partitioning blades 52*a* are configured to have the same shape, size, and installation interval and to have the same probability (in other words, lottery probability of a winning number) that the ball 59 falls into the respective ball pockets 52.

The ball sensor 58 is a sensor for detecting into what ball pocket 52 the ball 59 falls. The specific number and shape of the ball sensors 58 are not particularly limited. For example, in this embodiment, an optical sensor is disposed for each ball pocket 52 and it can be detected into what ball pocket 52 the ball 59 falls depending on which ball sensor detects the ball 59 (see FIG. 11).

The number display section 53 is a member (numeral board) for displaying the winning number in each roulette body. The specific configuration of the number display section 53 is not particularly limited, and the number display section 53 in this embodiment is formed on the inner circumference side of the corresponding ball pocket 52 in imitation of an actual roulette lottery apparatus and is formed of a light-transmitting member so as to look like shining. More specifically, spectators such as players feel as if the number display section shines by using light of the LEDs 56 disposed on the rear surface side of the number display section 53.

The LED 56 is a light source irradiating the number display section 53 with light from the rear surface side and making a predetermined number look like shining. The LEDs 56 may be disposed in the rotating member 30 so as to rotate along with the number display sections 53, but are disposed in the fixing member 20 instead of the rotating member 30 in this embodiment. In this way, when the LEDs 56 are configured not to rotate, the wirings of the LEDs 56 do not need to rotate and thus conduction members such as a rotor or a brush are unnecessary. The wirings or configurations are simplified in comparison with a case where the LEDs rotate. As a result, it is suitable from the viewpoint of durability or an extension in lifetime.

The LEDs 56 are arranged in a circulating band shape on the rear surface side of the number display sections 53. The lighting of the LEDs 56 is controlled by the control unit 80. For example, when the LEDs 56 are turned on in synchronization with the numbers of the number display sections 53 rotating along with the roulette body 51, only one number of the number display sections 53 can be made to look like shining. In the roulette lottery apparatus 1 according to this embodiment, only the number (winning number) corresponding to the ball pocket 52 into which the ball 59 falls is made to look like shining. At this time, when the LEDs 56 are controlled so as to sequentially flicker and to track the rotating number, an impression as if a light source is present behind the winning number and rotates along with the number display section 53 can be given to spectators.

The ball rail 55 is a guide of an annular shape or a conic shape (taper shape) opened to the near side (front side) that guides the ball 59 released from the corresponding ball release device 60. The ball rail 55 according to this embodiment is formed of a tubular member having a slightly larger diameter than that of the corresponding roulette body 51 and fixed to the fixing member 20 (see FIGS. 8 and 9). The ball 59 released from the ball release device 60 swings to the right and left sides (pendular movement) along the surface of the ball rail 55 while slowly decreasing the amplitude thereof. A drop-preventing guard 57 for preventing the ball 59 from being dropped to the front side (near side) of the ball rail 55 may be provided (see FIG. 6 and the like). The sizes (diameters) of the ball rails 55 have different curvatures depending on the sizes of the roulette bodies 51A, 51B, and 51C (see FIG. 9 and the like). The period of pendular movement of the ball 59 differs depending on the large, middle, and small roulette bodies 51A to 51C. Particularly, in the large roulette body 51A, since the ball 59A is large and it looks like moving relatively slowly in a pendular motion, a lottery looking profound by as much can be directed and is suitable for a final lottery out of the three roulette bodies 51A, 51B, and 51C.

Figure 9:
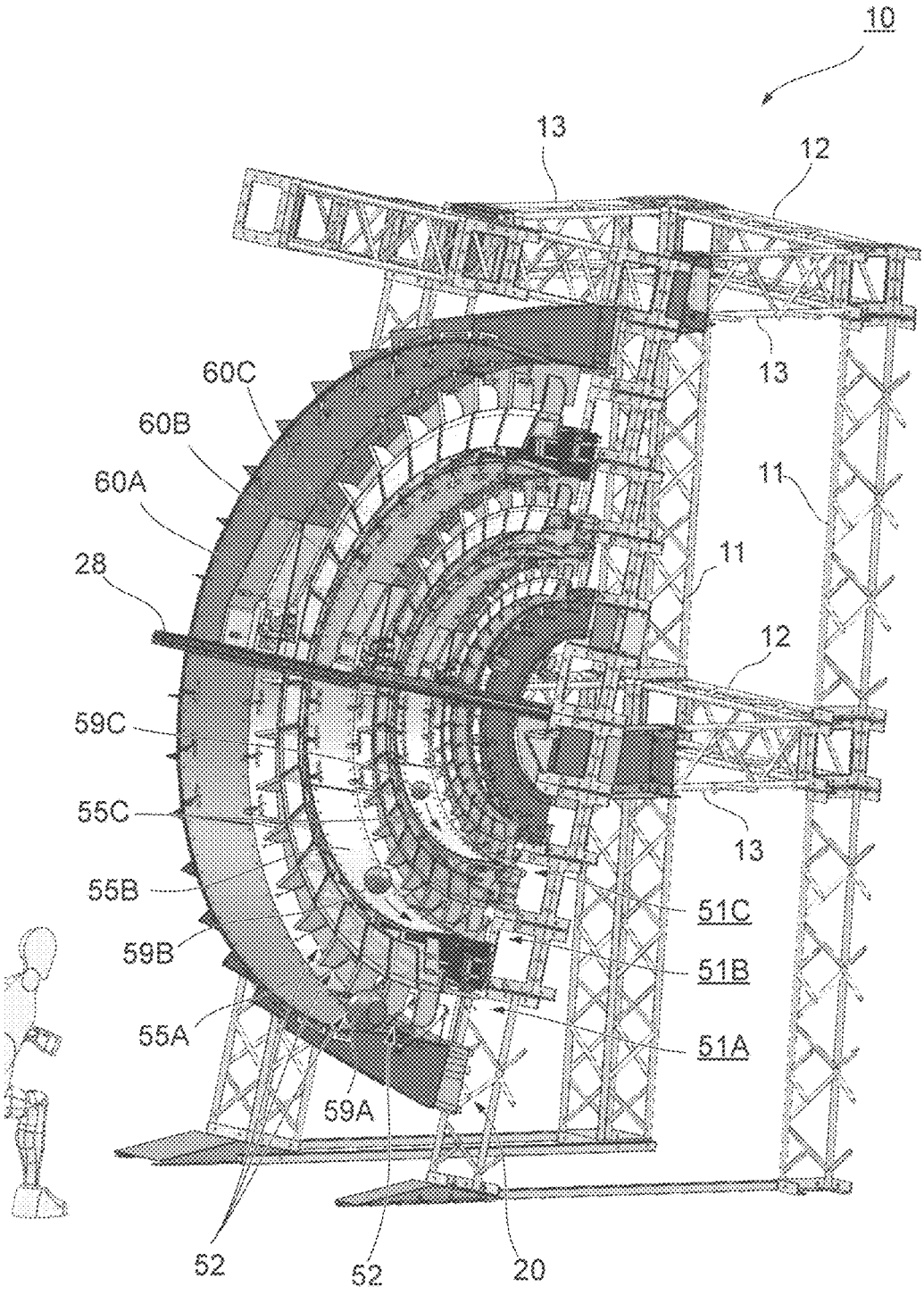
FIG. 9 is a perspective view illustrating a cross-section of the internal structure of the roulette lottery apparatus.

The ball rails 55 are arranged in a state where it is tilted to the rear surface side of the roulette lottery apparatus 1 similarly to the fixing members 20 (see FIG. 9 and the like). Each ball rail 55 normally applies a force toward the ball pockets 52 to the ball 59 swinging on the ball rail 55 and guides the ball 59 having a slowly-decreasing amplitude to fall into any ball pocket 52. In this embodiment, since the ball rail 55 has a conic shape (taper shape) opened to the near side (front side) and the tilt angle of the part for guiding the ball 59 to the ball pockets 52 can be changed, it is possible to adjust the time until the ball 59 is guided and falls into the ball pockets 52.

Figure 13:
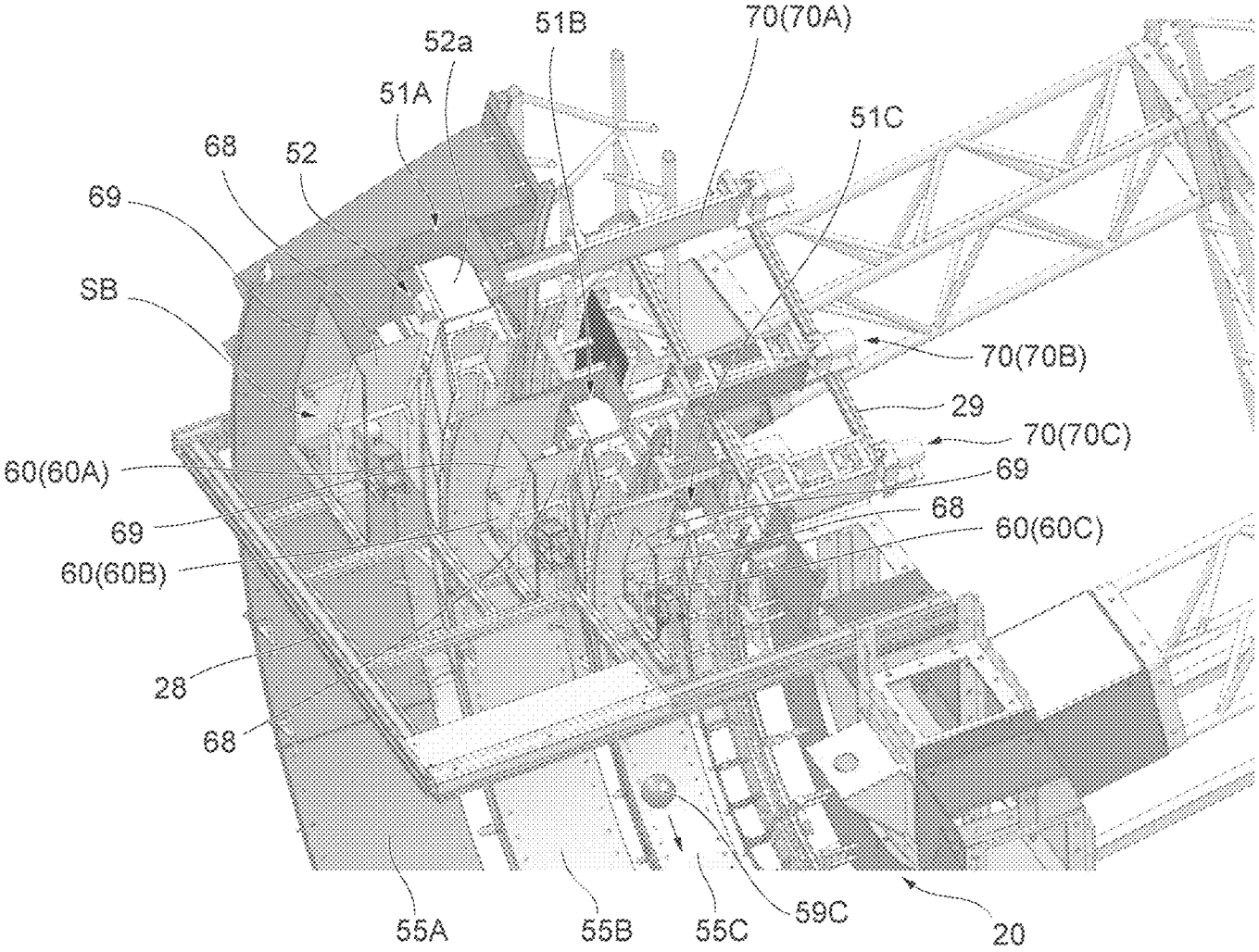
FIG. 13 is a perspective view illustrating a ball release device and a ball reset device, where the roulette lottery apparatus is partially cut.

The ball release device 60 is a device that releases and shoots the ball 59 in a standby state at the time of carrying out a roulette lottery. The ball release device 60 according to this embodiment is fixed to the fixing member 20 via a ball release device-fixing frame 28 at a position suitable for releasing the held ball 59 to the ball rail 55, for example, about a 9:00 position (standby position which is denoted by reference sign SB in FIG. 13) when facing the roulette bodies 51 (see FIGS. 7, 9, and 13 and the like). A configuration example of the ball release device 60 will be described below.

Figure 24:
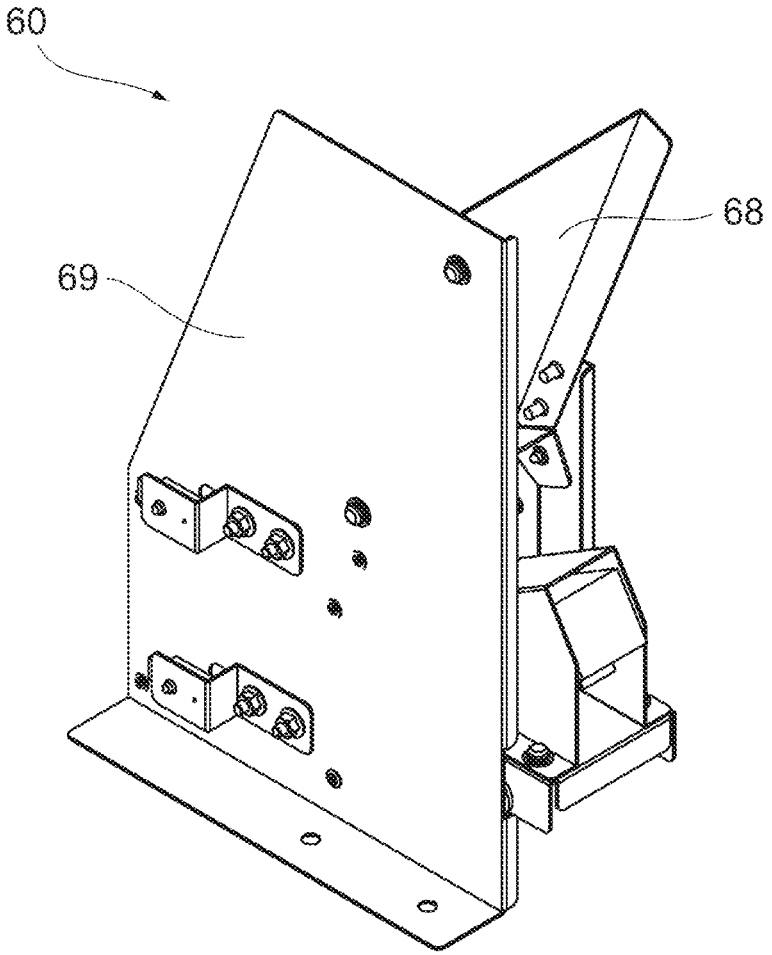
FIG. 24 is a perspective view illustrating the ball release device.
Figure 25:
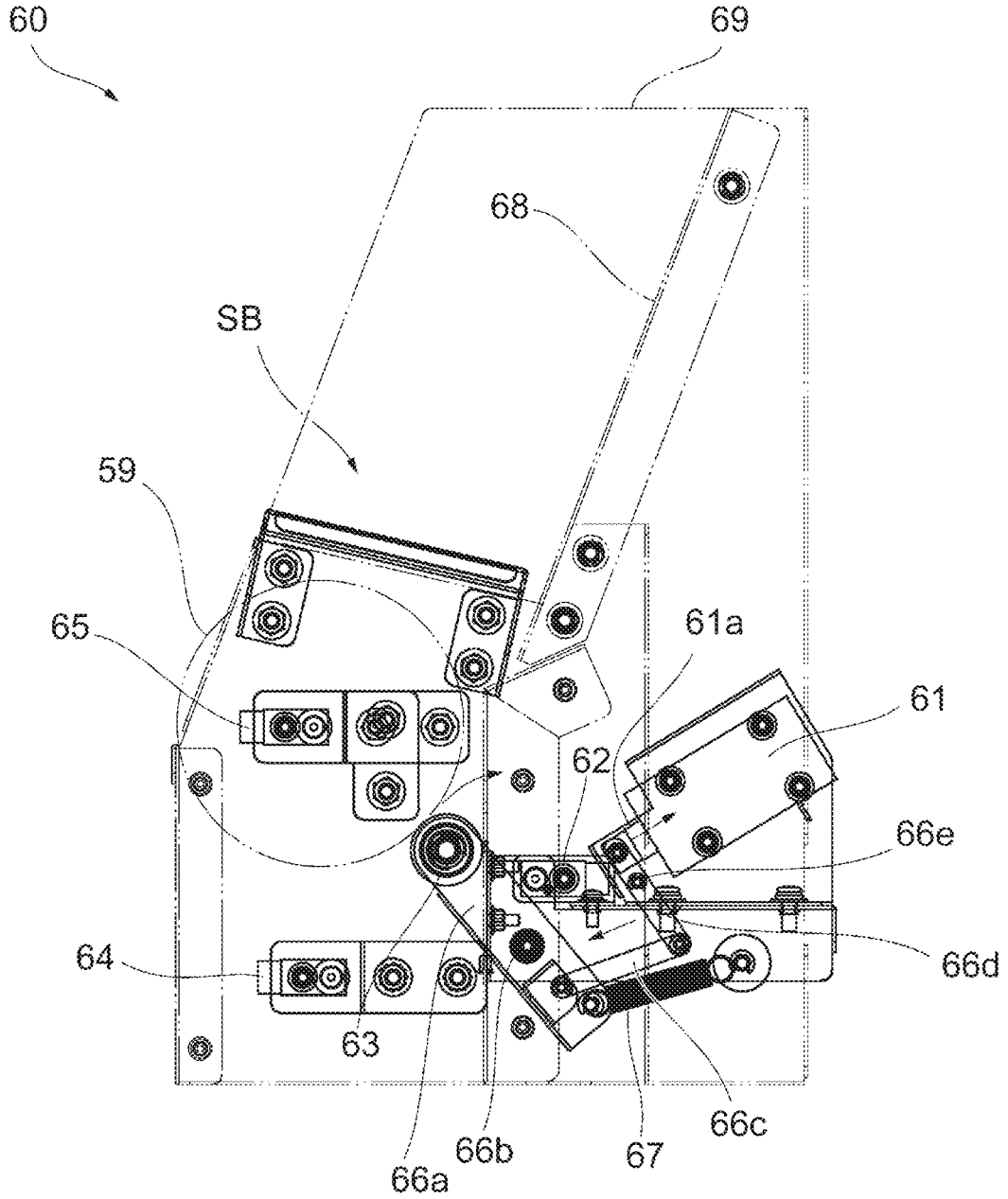
FIG. 25 is a diagram illustrating an inner configuration of the ball release device.

The ball release device 60 according to this embodiment comprises members such as a solenoid 61, a solenoid sensor 62, a roller 63, a release sensor 64, a setting sensor 65, a roller support lever 66*a*, a link 66*c*, a transmission lever 66*d*, and a coil spring 67 (see FIG. 25 and the like). These members are attached to an attachment plate 68 in which two plate-like members are combined with an angle and a cover plate 69 disposed on the front side of the roulette lottery apparatus 1 when viewed from the attachment plate 68 (see FIGS. 13 and 24 and the like). A passing space of the ball 59 is formed in the attachment plate 68 and the cover plate 69 (see FIG. 25 and the like).

The roller 63 regulating the ball 59 is attached to the tip of the roller support lever 66*a* which is rotatable about a pivot 66*b*. The roller support lever 66*a* is in a state (standby state) in which the base end thereof is drawn and biased with the coil spring 67 and the roller 63 protrudes into the passing space of the ball 59 (see FIG. 25). The roller support lever 66*a* is connected to a plunger 61*a* of the solenoid 61 via the link 66*c* and the transmission lever 66*d*. When the solenoid 61 is supplied with power and the plunger 61*a* is drawn, the transmission lever 66*d* swings in the clockwise direction in FIG. 25 about the pivot 66*e* and movement thereof is transmitted to the roller support lever 66*a* via the link 66*c*. The roller support lever 66*a* to which movement is transmitted swings in the clockwise direction in FIG. 25 about the pivot 66*b* and causes the roller 63 to retreat from the ball passing space. When the roller 63 retreats, the ball 59 in the standby state is released and falls.

The solenoid sensor 62 is a sensor for detecting the roller 63 or the roller support lever 66*a* retreating from the ball passing space and checks that the roller 63 makes predetermined movement. The setting sensor 65 checks presence of the ball 59 at the standby position. The release sensor 64 is disposed in the vicinity of a ball-falling hole in the ball release device 60 and detects that the ball 59 is released and falls.

Figure 6:
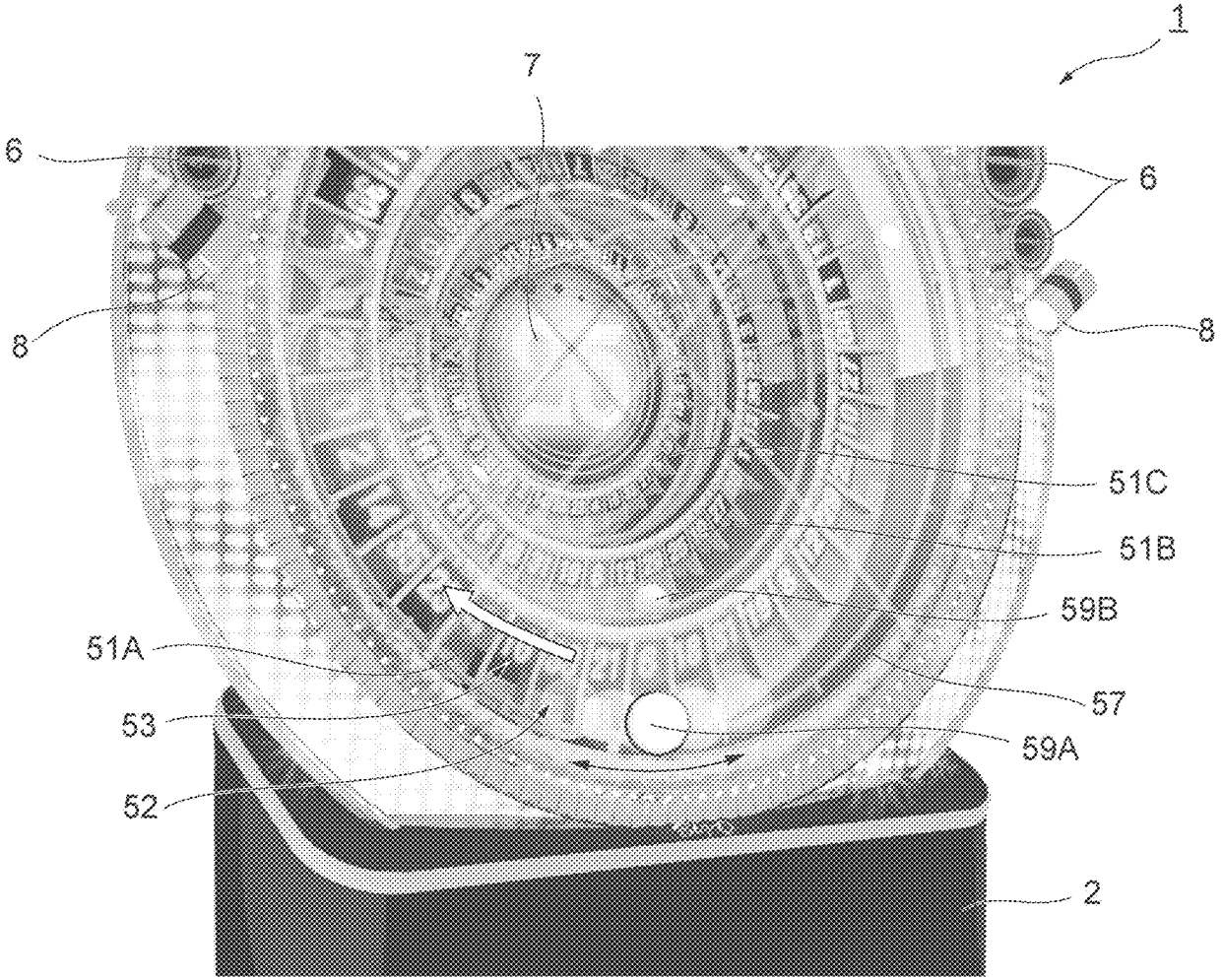
FIG. 6 is a diagram illustrating a roulette lottery apparatus at the time of carrying out a lottery when viewed from the diagonal front side.

The ball 59 released from the ball release device 60 swings to the right and left sides along the surface of the ball rail 55, slowly decreases the amplitude, falls down from the ball rail 55, and enters into any ball pocket 52 of the roulette body 51 (see FIG. 6 and the like). The movement of the ball 59 at this time varies depending on various factors (such as the size and the weight of the ball 59, the speed at the time of release, the size of the roulette body 51, the size of each ball pocket 52, the size or shape of the partitioning blades 52*a*, and the tilt angle of the rotation center line Z of the roulette body 51 to the rear side with respect to the horizontal plane), and the ball may smoothly enter into any ball pocket 52 or may bound from the partitioning blades 52*a* and swing for a long time. The movement of the ball 59 is greatly different from that in the conventional roulette game system and can give a fresh or interesting impression to spectators.

Thereafter (for example, after the balls 59 enter into the ball pockets 52 in all the three roulette bodies 51A to 51C and the winning numbers are determined), in order to recover the balls 59 falling into the ball pockets 52, the roulette bodies 51 rotate in the clockwise direction in the drawing to move the balls 59 to the positions (recovery positions) immediately before the ball reset devices 70.

Figure 26:
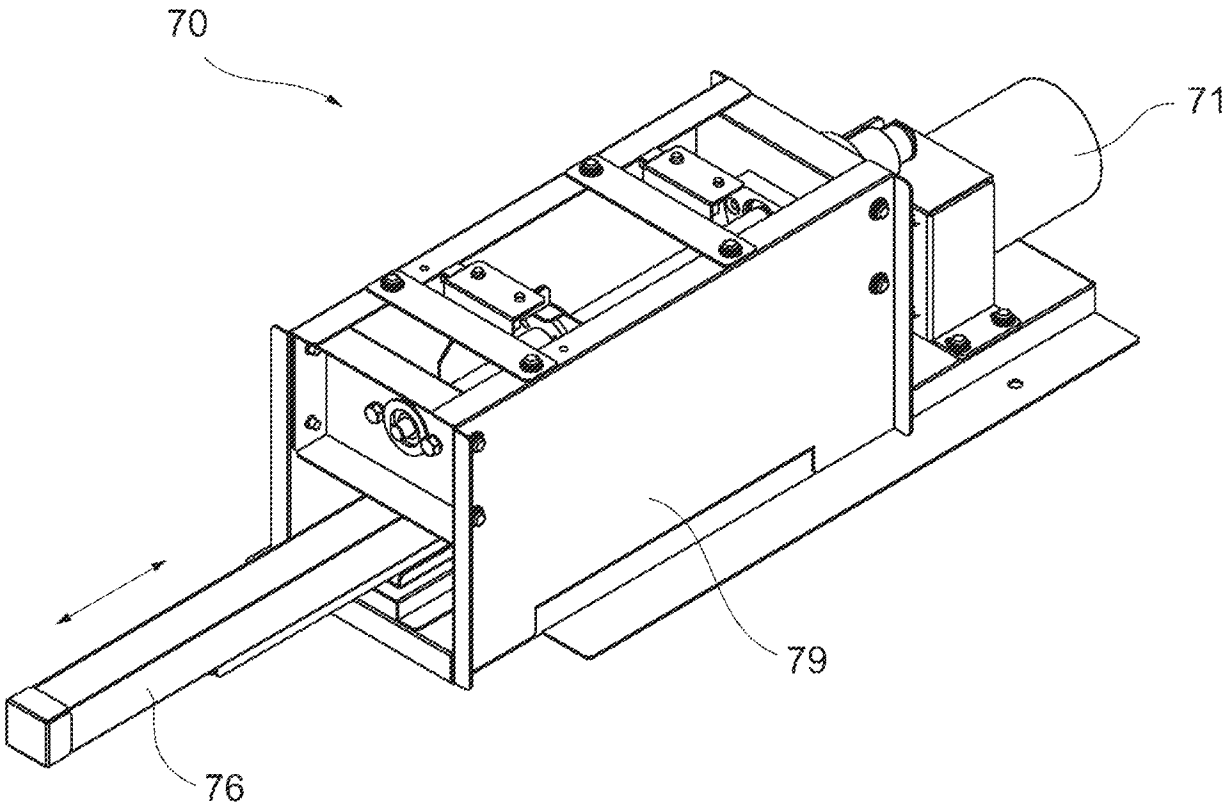
FIG. 26 is a perspective view illustrating the ball reset device.

The ball reset device 70 is a device that extrudes the ball 59 moving to the recovery position to the front side of the roulette lottery apparatus 1 and moves and resets (returns to the standby state) the ball to the standby position. The ball reset device 70 according to this embodiment is fixed to the fixing member 20 via a ball reset device-fixing frame 29 at a position suitable for extruding the ball 59 to the ball release device 60, for example, a position on the rear side of the ball release device 60 (see FIG. 13). A configuration example of the ball reset device 70 will be described below (see FIGS. 26 and 27).

Figure 27:
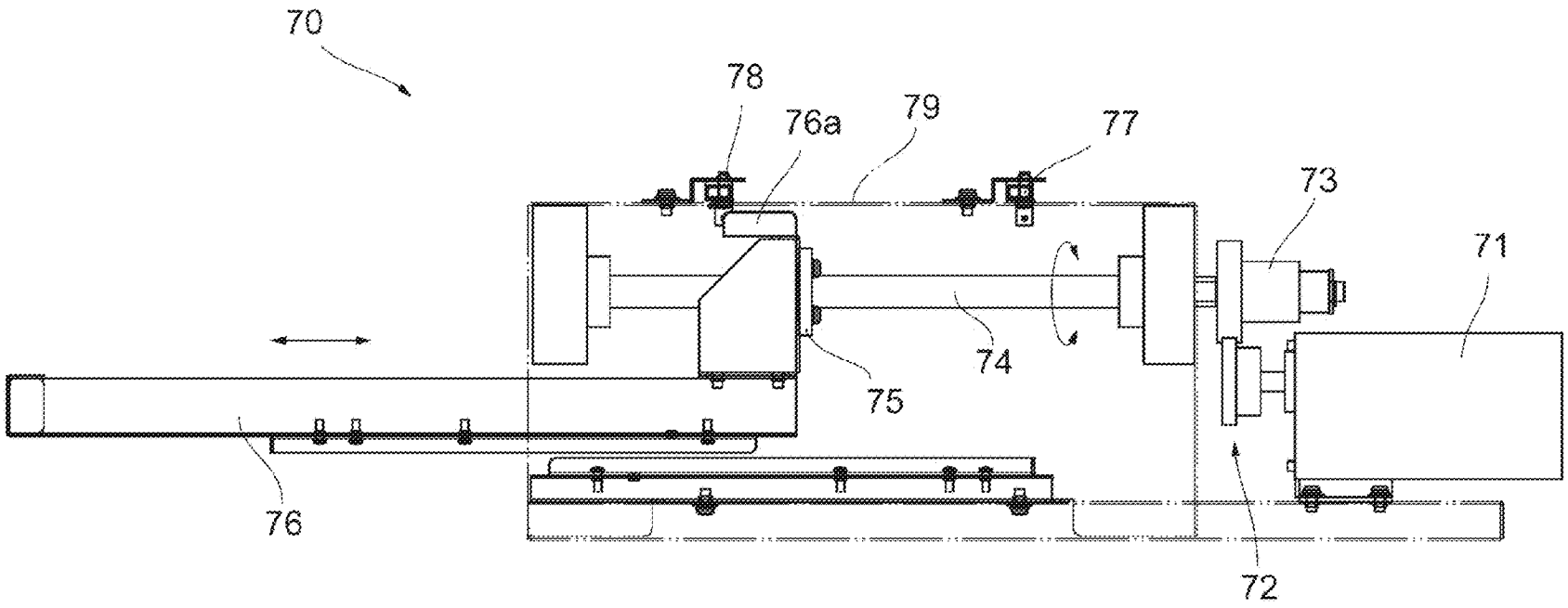
FIG. 27 is a diagram illustrating an inner configuration of the ball reset device.

The ball reset device 70 according to this embodiment comprises members such as a ball reset motor 71, a gear train 72, a torque limiter 73, a ball screw 74, a change nut 75, a ball extruding rod 76, a sensor dog 76*a*, a home sensor 77, and a limit sensor 78 (see FIG. 27). These members are attached to a channel-like attachment frame member 79.

The ball reset motor 71 transmits a drive force via the gear train 72 to rotate the ball screw 74. The ball screw 74 is rotatably supported by the attachment frame member 79 and moves the ball extruding rod 76 attached to the change nut 75 on the ball screw 74 in the front-and-rear direction (to the front side or the rear side of the roulette lottery apparatus 1).

The ball extruding rod 76 moves forward to the front side from a home position (initial position) to extrude the ball 59 to the ball release device 60 and then moves backward to the rear side to return to the home position. The forward and backward movement of the ball extruding rod 76 is determined depending on the rotation direction (forward rotation or backward rotation) of the ball reset motor 71. The stop position in forward movement and backward movement of the ball extruding rod 76 is detected by causing the sensor dog 76*a* attached to the ball extruding rod 76 to pass through any one of the home sensor 77 and the limit sensor 78 disposed in the attachment frame member 79.

The home sensor 77 detects that the ball extruding rod 76 moves backward to the home position. The limit sensor 78 detects that the ball extruding rod 76 moves forward to a predetermined ball extrusion position (limit position). The torque limiter 73 is attached to the shaft of the ball screw 74 and protects the ball extruding rod 76 and the ball reset motor 71 when problems such as overrun or overload occur.

A series of operations of the ball reset device 70 will be simply arranged as follows. First, it is checked whether the ball extruding rod 76 is located at the home position by checking the home sensor 77. Then, the ball reset motor 71 is rotated to cause the ball extruding rod 76 to move forward. When the limit sensor 78 detects the sensor dog 76*a*, it is determined that the ball extruding rod 76 moves forward to the limit position, and the ball reset motor 71 is stopped. After a predetermined time passes, the ball reset motor 71 is reversely rotated to cause the ball extruding rod 76 to move backward. When the home sensor 77 detects the sensor dog 76*a*, it is determined that the ball extruding rod 76 returns to the home position, and the ball reset motor 71 is stopped.

The control unit 80 comprises a CPU and a memory (a ROM and a RAM), and embodies various functions to control the game system 100 as a whole by executing a game program 91 in the storage unit 90. The functions embodied by the control unit 80 comprise a game control unit 81, a drive system control unit 82, a roulette body control unit 83, a ball release control unit 84, a ball reset control unit 85, a display control unit 86, a sound control unit 87, and an illumination control unit 88 (see FIG. 2).

Figure 2:
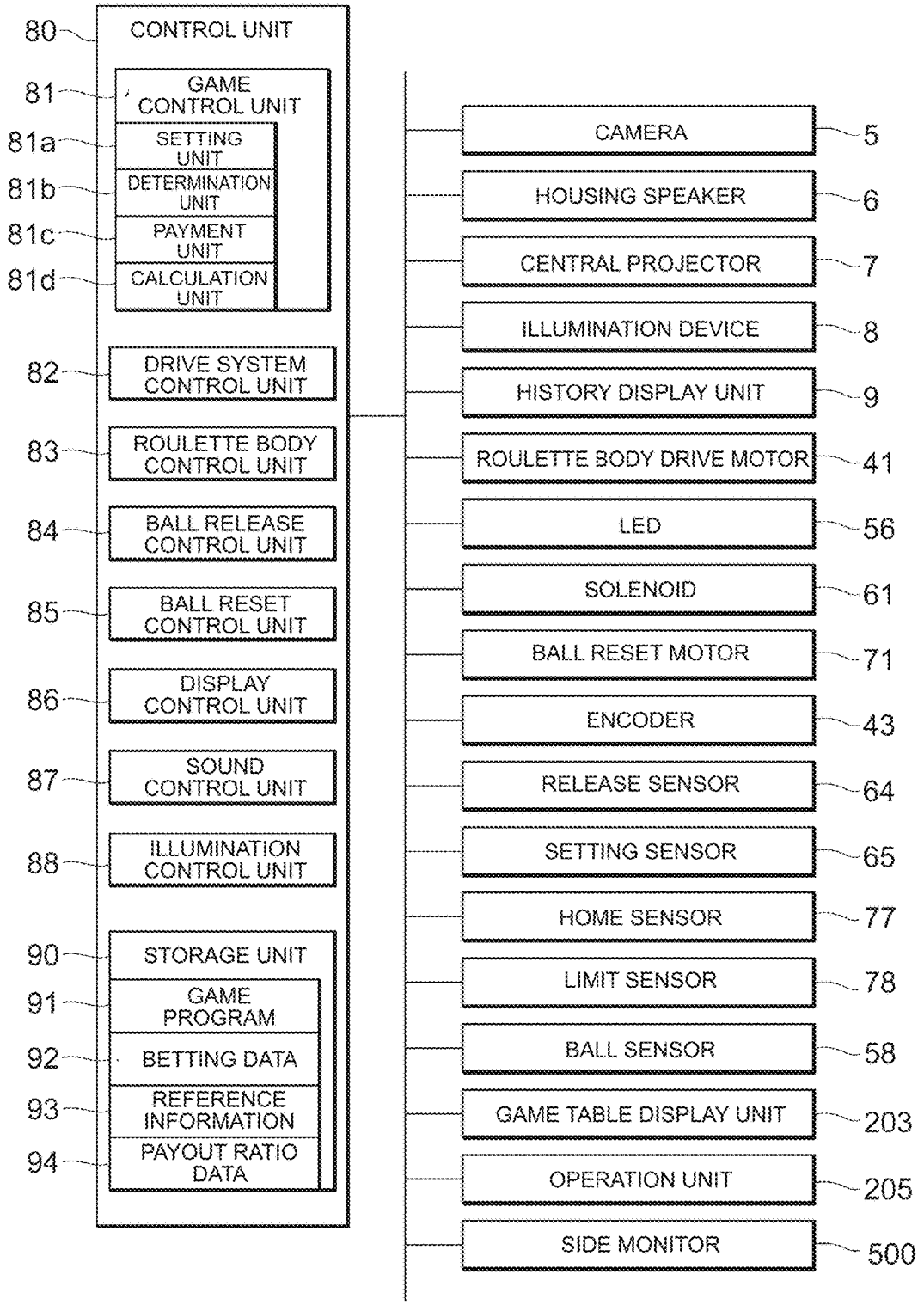
FIG. 2 is a block diagram illustrating a configuration example of the roulette game system.

The control unit 80 controls various elements of the game system 100, for example, the camera 5, the housing speakers 6, the central projector 7, the illumination devices 8, the history display unit 9, the roulette body drive motors 41, the LEDs 56, the solenoids 61, the ball reset motors 71, the game table display units 203, the operation units 205, and the side monitors 500 (see FIG. 2). For example, operation signals from the operation unit 205 for allowing a player to perform a betting operation in a game table displayed on the game table display unit 203 or detection signals from the encoders 43, the release sensors 64, the setting sensors 65, the home sensors 77, the limit sensors 78, and the ball sensors 58, and the like are transmitted to the control unit 80. A game program 91, betting data 92, reference information 93, payout ratio data 94, and the like are stored in the storage unit 90 (see FIG. 2).

The game control unit 81 controls the roulette game by executing the game program 91 in the storage unit 90. The game control unit 81 stores the betting data 92 based on the progress of the game or the reference information 93 representing the histories of the past game results, and accumulates the payout ratio data 94.

The game control unit 81 also serves as a setting unit 81*a*, a determination unit 81*b*, a payment unit 81*c*, and a calculation unit 81*d* for carrying out the roulette game. The setting unit 81*a* sets various values of the roulette game with the progress of the game. The determination unit 81*b* determines a winning number (numeral corresponding to the ball pocket 52 into which the ball 59 fall) on the basis of the detection signal from the ball sensor 58. The payment unit 81*c* performs payment for predicted settings when the determination unit 81*b* determines that the prediction wins. The payment unit 81*c* performs a process of paying the number of chips corresponding to the betting. The calculation unit 81*d* performs a predetermined calculation (for example, a calculation of a payout ratio or probabilities of the respective winning numbers) on the basis of the determined winning number and stores the calculated payout ratio as the payout ratio data 94 (see FIG. 2).

The drive system control unit 82 controls the operations (the rotation, the rotation speed, and the stop) of the roulette bodies 51 through the use of the roulette body drive motor 41. The ball release control unit 84 controls the ball release operation in the ball release device 60. The ball reset control unit 85 controls the ball reset operation in the ball reset device 70. The display control unit 86 controls the display operations of the game table display unit 203, the central projector 7, and the history display unit 9 under the control of the control unit 80. The sound control unit 87 controls the outputs of voices or various sound effects from the housing speakers 6 and the like with the progress of the game. The illumination control unit 88 controls illumination in the illumination devices 8 and the like.

The storage unit 90 is embodied by a hard disk drive or the like and stores various programs or data. The data stored in the storage unit 90 includes the betting data 92 indicating betting states set by the setting unit 81*a*, the reference information 93 (history information of a winning number or an appearance ratio of the numbers in past games) as a betting reference which is provided to players in a betting-enabling time, and the payout ratio data 94 indicating a current payout ratio calculated by the calculation unit 81*d*.

Figure 28:
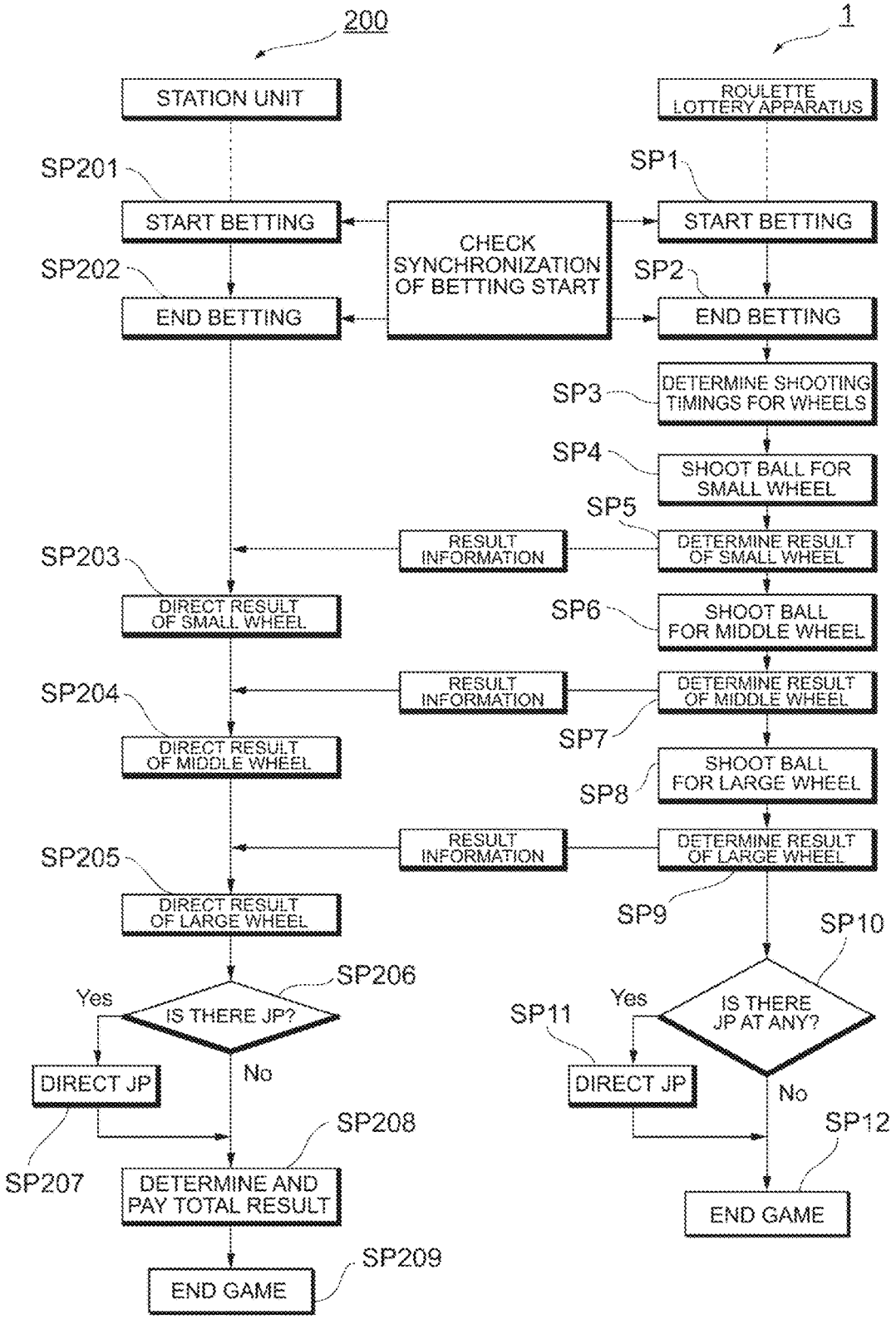
FIG. 28 is a flowchart illustrating a series of operations in the roulette lottery apparatus along with a series of operations in a station unit.

A series of operations in the roulette lottery apparatus 1 according to this embodiment will be described below in conjunction with the flowchart along with a series of operations in the station units 200 (see FIG. 28). In the below description, the large, middle, and small roulette bodies 51 are also referred to as a large wheel (51A), a middle wheel (51B), and a small wheel (51C).

After the betting-enabling time which is determined with synchronization between the roulette lottery apparatus 1 and the station units 200 passes (steps SP1, SP2, SP201, and SP202), the control unit 80 receives a lottery start command via the network 400 and the master unit 300 and determines a ball shooting timing in each wheel (roulette bodies 51) (step SP3).

After the shooting timing is determined, first, the ball 59 in the small wheel is released from the standby state and is shot (step SP4). When the ball 59 falls into any ball pocket 52 and a winning number is determined as the result in the small wheel (step SP5), the result information is transmitted to the station units 200, is displayed as history information on the game table display unit 203, and is directed as the lottery result in the small wheel (step SP203).

In the roulette lottery apparatus 1, when the ball 59 falls into a ball pocket 52, the small wheel is made to rotate by about one turn in the clockwise direction while causing the LEDs 56 to sequentially flicker so that only the number display section 53 corresponding to the ball pocket 52 looks like shining. When the ball pocket 52 arrives immediately below (at a 6:00 position) after about one turn, the small wheel is stopped and this state is maintained until all the roulette lotteries using the three wheels are ended. In this way, when the ball pocket 52 is maintained immediately below (at the 6:00 position) along with the ball 59, spectators can easily visually recognize the result until all the lotteries are ended (see FIG. 3 and the like).

Subsequently, the ball 59 in the middle wheel is released from the standby state and is shot (step SP6). When the ball 59 falls into any ball pocket 52 and a second winning number is determined as the determination result in the middle wheel (step SP7), the result information is transmitted to the station units 200, is displayed as history information on the game table display unit 203, and is directed as the lottery result in the middle wheel (step SP204).

In the roulette lottery apparatus 1, the middle wheel is made to rotate by about one turn in the clockwise direction while causing the LEDs 56 to sequentially flicker so that only the number display section 53 corresponding to a ball pocket 52 into which the ball 59 falls looks like shining. When the ball pocket 52 arrives immediately below (at the 6:00 position) after about one turn, the middle wheel is stopped and this state is maintained until all the roulette lotteries using the three wheels are ended (see FIG. 3 and the like).

Thereafter, the ball 59 in the large wheel is released from the standby state and is shot (step SP8). When the ball 59 falls into any ball pocket 52 and a third winning number is determined as the determination result in the large wheel (step SP9), the result information is transmitted to the station units 200, is displayed as history information on the game table display unit 203, and is directed as the lottery result in the large wheel (step SP205).

In the roulette lottery apparatus 1, the large wheel is made to rotate by about one turn in the clockwise direction while causing the LEDs 56 to sequentially flicker so that only the number display section 53 corresponding to a ball pocket 52 into which the ball 59 falls looks like shining. When the ball pocket 52 arrives immediately below (at the 6:00 position) after about one turn, the large wheel is stopped. At this time, the winning numbers of the small wheel, the middle wheel, and the large wheel are arranged in a line (see FIG. 3 and the like).

When a jackpot (JP, big win) occurs in any station unit 200 as the determination result of the three winning numbers through the roulette lotteries using the three roulette bodies (Yes in step SP206), jackpot directing is carried out (step SP207). When a jackpot does not occur in any station unit (NO in step SP206), the jack directing is not performed and the determination and payment of the total result is performed (step SP208). Then, the game ends (step SP209). In the roulette lottery apparatus 1, when a jackpot occurs in any station unit 200 (YES in step SP10), the roulette lottery apparatus 1 also performs the jackpot directing (step SP11) and then the game ends (step SP12). An example of the jackpot in the game system 100 according to this embodiment is an event in which the winning numbers in the large, middle, and small roulette bodies 51A, 51B, and 51C are set to the same number.

When the game ends, the large wheel, the middle wheel, and the small wheel are made to rotate in the clockwise direction and the balls 59 are recovered and returned to the standby states. Specifically, when the balls 59 arrive immediately before the ball reset devices 70, the wheels are stopped and the balls 59 are extruded with the ball extruding rods 76 so as to move into the ball release devices 60.

As illustrated in the drawings, the roulette lottery apparatus 1 according to this embodiment is a large-size apparatus which is incomparable for a roulette game and exhibits overwhelming presence. In a general roulette lottery apparatus, since a dealer manually rotates a roulette board, the size of the roulette board or the ball is naturally determined (a value in a certain range) and thus the shape, type, size, and the like of a roulette lottery apparatus are considered to be based on a general notion from such phenomena or backgrounds. In many cases, for spectators considered to have such a general notion, since the roulette lottery apparatus 1 according to this embodiment has a large size and performs roulette lotteries using plural large-size roulette bodies 51 in a state where the surface (rotation plane) is raisable, it is possible to give a novel and strong impression which is completely different from the notions so far.

The specific size of the roulette lottery apparatus 1 is not particularly limited, and for example, the outer diameter X of the largest (that is, the large roulette body 51A) out of the plural roulette bodies 51A, 51B, and 51C can be set to 3 m or more (see FIG. 8). The roulette lottery apparatus 1 is powerful and the movement of the roulette bodies 51 or the balls 59 is conspicuous at far positions. In addition, according to the roulette lottery apparatus 1 having such a large size, it is possible to provide a novel and interesting game giving a sense of unity in which multiple players simultaneously enjoy the same roulette game (a game using a single roulette lottery apparatus 1).

The roulette lottery apparatus 1 preferably implements such a height and a size to attract eyes of players sitting at the station units 200 and persons (spectators) viewing the game in the back or vicinity thereof to the roulette bodies 51 or the balls 59. Although not described in detail in this specification, it is possible to direct a powerful feeling and presence which are completely different from those in the conventional roulette lottery apparatuses by combining visual effects based on various decorative devices (which include flickering lighting devices) decorating the roulette lottery apparatus 1 and auditory effects (sound effects).

The present disclosure is not limited to the above-mentioned preferred embodiment and can be modified in various forms without departing from the gist of the present disclosure. For example, in the above-mentioned embodiment, the roulette lottery apparatus 1 having three roulette bodies 51A, 51B, and 51C of large, middle, and small roulette bodies is exemplified, but this is a preferred example and the number of roulette bodies 51 is not limited to three.

The rotation directions of the roulette bodies 51 at the time of performing a lottery or at the time of recovering (resetting) the balls 59 are not limited to the clockwise direction. For example, only one or two roulette bodies 51 may be made to rotate in the counterclockwise direction.

At the time of performing a lottery, the circumferential speeds (angular speeds) of the roulette bodies 51 may set to be constant or may be changed in the course of rotation, or the roulette bodies may be made to rotate intermittently. That is, the roulette bodies may be made to irregularly rotate.

In the roulette lottery apparatus 1 according to the embodiment having the above-mentioned configuration, the rotation center line Z of the roulette bodies 51 are tilted 10° about the horizontal plane (a state of Y=80°), but this is only a specific example. In brief, in the roulette lottery apparatus 1 according to the present disclosure, the rotation center line Z of the roulette bodies 51 is horizontal or similar thereto, but the range or the specific slope thereof may be appropriately changed depending on sizes or specifications thereof.

The present disclosure can be suitably applied to a roulette lottery apparatus for a roulette game.

DESCRIPTION OF REFERENCE NUMERALS

1: roulette lottery apparatus
2: base
6: housing speaker
7: central projector
8: illumination device
9: history display unit
10: support frame (support member)
11: vertical frame
12: horizontal frame
13: front-and-rear frame
14: tilt frame
20: fixing member
21: wheel rail base
22: (plural) bracket
23: wheel rail (annular rail)
**23*f***: arc-like fixing member (forming wheel rail)
24: joint (junction between wheel rails)
25: screw
26: adjustment screw
27: output bearing member
28: ball release device-fixing frame
29: ball reset device-fixing frame
30: rotating member
31: carriage
**31*a***: base
**31*b***: roller
**31*c***: pin hole
**31*d***: another pin hole
32: annular rotating body
**32*b***: arc-like rotating member
**32*c***: through-hole
**32*d***: another through-hole
33: rotation axis
**33*a***: pin
**33*b***: washer
**33*c***: sleeve
34: fixing pin
35: lubricating member
36: pin gear wheel
40: drive system
41: roulette body drive motor (drive source)
**41*a***: output shaft
42: sprocket (pin gear)
43: encoder
50: roulette constituent member
51 (51A, 51B, 51C): roulette body (large roulette body 51A, middle roulette body 51B, small roulette body 51C)
52: ball pocket
**52*a***: partitioning blade (ball pocket)
53: number display section
54: directing illumination for ball revolution
55: ball rail (ball guide member)
56: LED (light source)
57: drop-preventing guard
58: ball sensor
59 (59A, 59B, 59C): ball (ball for large roulette body 51A, ball for middle roulette body 51B, ball for small roulette body 51C)
60: ball release device
61: solenoid
**61*a***: plunger
62: solenoid sensor
63: roller
64: release sensor
65: setting sensor
**66*a***: roller support lever
**66*b***: pivot
**66*c***: link
**66*d***: transmission lever
**66*e***: pivot
67: coil spring
68: attachment plate
69: cover plate
70: ball reset device
71: ball reset motor
72: gear train
73: torque limiter
74: ball screw
75: change nut
76: ball extruding rod
**76*a***: sensor dog
77: home sensor
78: limit sensor
79: attachment frame member
80: control unit
81: game control unit
**81*a***: setting unit
**81*b***: determination unit
**81*c***: payment unit
**81*d***: calculation unit
82: drive system control unit
83: roulette body control unit
84: ball release control unit
85: ball reset control unit
86: display control unit
87: sound control unit
88: illumination control unit
90: storage unit
91: game program
92: betting data
93: reference information
94: payout ratio data
100: game system
200-N: station unit
201: housing
203: game table display unit
205: operation unit

300: master unit
500: side monitor
SB: standby position
X: outer diameter of large roulette body 51A
Y: rising angle of roulette body (angle formed by rotation plane of roulette body and horizontal plane)
Z: rotation center line

The invention claimed is:

1. A roulette lottery apparatus for a roulette game comprising:

a plurality of roulette bodies in which, in each of the plurality of roulette bodies, a plurality of ball pockets into which lottery balls enter is arranged in an annular shape, the plurality of roulette bodies being held so as to be rotatable about a common rotation center line that is not vertical in a state where a rotation plane of the ball pockets is tilted out of the horizontal plane, each of the plurality of roulette bodies having different diameters;

a plurality of balls each associated with a respective one of the plurality of roulette bodies, wherein the balls associated with the roulette body located on the inner side among the plurality of roulette bodies are smaller than the balls associated with the roulette body located on the outer side;

a drive source that rotationally drives the roulette bodies;

a control unit operative to cause each of the plurality of roulette bodies to rotate at angular speeds that are different from each other; and ball guide members that guide the balls to enter into any ball pocket among the plurality of ball pockets while permitting the balls to swing from side to side, wherein the plurality of roulette bodies is arranged in a stepped state in which the roulette bodies are displaced in a direction of the rotation center line.

2. The roulette lottery apparatus according to claim 1, further comprising a plurality of annular rails, wherein the plurality of roulette bodies rotates along any one of the plurality of annular rails.

3. The roulette lottery apparatus according to claim 1, wherein the roulette bodies located on an inner side among the plurality of roulette bodies are arranged so as to be closer to a rear surface of the roulette lottery apparatus than roulette bodies located on an outer side.

4. The roulette lottery apparatus according to claim 3, wherein the ball pockets of the roulette body located on the inner side among the plurality of roulette bodies are smaller than the ball pockets located on the outer side.

5. The roulette lottery apparatus according to claim 3, wherein the control unit is operative to cause each of the plurality of roulette bodies to rotate at circumferential speeds that are equal to each other.

6. The roulette lottery apparatus according to claim 3, comprising a control unit operative to cause lotteries using the plurality of roulette bodies to be sequentially carried out.

7. The roulette lottery apparatus according to claim 3, wherein at least a part of a number display section of the roulette bodies is formed of a light-transmitting material and a light source that emits light from a rear surface of the number display section is further installed.

8. The roulette lottery apparatus according to claim 7, wherein the light source is fixed so as not to rotate.

9. The roulette lottery apparatus according to claim 6, wherein the control unit is operative to cause the lotteries using the plurality of roulette bodies to be carried out from the inner side to the outer side.

10. The roulette lottery apparatus according to claim 9, wherein the control unit is operative to stop one roulette body and then to rotate a next roulette body at a time of carrying out the lotteries using the plurality of roulette bodies.

* * * * *